US007098584B2

(12) United States Patent
Sato et al.

(10) Patent No.: US 7,098,584 B2
(45) Date of Patent: Aug. 29, 2006

(54) DEFLECTION YOKE

(75) Inventors: Hidenori Sato, Kumamoto (JP); Yasuhiro Torigoe, Kumamoto (JP); Yuji Shima, Kumamoto (JP); Masahiro Kamada, Kumamoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 215 days.

(21) Appl. No.: 10/678,399

(22) Filed: Oct. 3, 2003

(65) Prior Publication Data

US 2004/0113536 A1 Jun. 17, 2004

(30) Foreign Application Priority Data

Oct. 9, 2002 (JP) ..... 2002-296200
Oct. 30, 2002 (JP) ..... 2002-315684
Mar. 27, 2003 (JP) ..... 2003-088446

(51) Int. Cl.
*H01J 29/70* (2006.01)

(52) U.S. Cl. ..... 313/440; 335/213; 335/299

(58) Field of Classification Search ..... 313/440; 335/210, 213, 299

See application file for complete search history.

(56) References Cited

U.S. PATENT DOCUMENTS

| | | | | |
|---|---|---|---|---|
| 4,272,727 | A | 6/1981 | Nieuwendijk et al. | |
| 4,409,578 | A | 10/1983 | Beelaard et al. | |
| 4,687,966 | A * | 8/1987 | Carroll et al. | 313/440 |
| 4,754,190 | A * | 6/1988 | Hinotami et al. | 313/422 |
| 4,789,806 | A | 12/1988 | Meershoek | |
| 6,097,163 | A | 8/2000 | Chauvin et al. | |
| 6,166,484 | A * | 12/2000 | Okuyama et al. | 313/440 |
| 6,198,368 | B1 | 3/2001 | Nam | |
| 6,462,450 | B1 * | 10/2002 | Haussecker et al. | 310/156.09 |

FOREIGN PATENT DOCUMENTS

| | | | |
|---|---|---|---|
| CN | 1278633 | A | 1/2001 |
| CN | 1332887 | A | 1/2002 |
| DE | 29 33 945 | C2 | 8/1979 |
| DE | 30 40 307 | A1 | 10/1980 |
| DE | 197 07 069 | A1 | 2/1997 |
| DE | 199 29 788 | A1 | 6/1999 |
| EP | 1231625 | A1 | 8/2002 |
| JP | 63-95160 | | 6/1988 |
| JP | 03257742 | A | 11/1991 |

(Continued)

*Primary Examiner*—Ashok Patel
(74) *Attorney, Agent, or Firm*—RatnerPrestia

(57) ABSTRACT

A deflection yoke is used for a cathode ray tube (CRT) including a glass tube having a screen surface and a straight portion for accommodating an electron gun. The deflection yoke includes a main deflection yoke including first and second horizontal deflecting coils and first and second vertical deflecting coils, and a sub-deflection yoke provided at a side of the main deflection yoke towards the electron gun of the CRT. The first and second horizontal deflecting coils have substantially saddle shapes and includes first and second coil-connection-wire sections and first and second horizontal deflection sections, respectively. The first and second coil-connection-wire sections are wound in a direction perpendicular to a tube axis of the CRT and along the straight portion, respectively. The first and second horizontal deflection sections are located towards the screen surface from the first and the second coil-connection-wire sections, respectively. In the deflection yoke, magnetic lines emitted from a rear end of the horizontal deflecting coil towards the electron gun decreases. An induced voltage generated at the sub-deflection yoke accordingly decreases, and thus, a noise on a screen noise produced due to the induced voltage is reduced.

10 Claims, 40 Drawing Sheets

FOREIGN PATENT DOCUMENTS

| | | | |
|---|---|---|---|
| JP | 2001-507158 | A | 5/2001 |
| JP | 2002-075250 | A | 3/2002 |
| JP | 2002-175765 | A | 6/2002 |
| WO | WO 98/28770 | | 7/1998 |

* cited by examiner

DEFLECTION YOKE

FIELD OF THE INVENTION

The present invention relates to a deflection yoke used for a triple-cathode ray tube (CRT) type projector, such as a projection type receiver and a projector.

BACKGROUND OF THE INVENTION

A deflection yoke deflects an electron beam emitted from an electron gun of a cathode ray tube (CRT) in order to display a screen, and includes a pair of horizontal deflecting coils and a pair of vertical deflecting coils.

FIG. 1 shows a configuration of a deflection yoke. Sub-deflection yoke 1 is provided at a rear end of main deflection yoke 2 having the horizontal deflecting coils and the vertical deflecting coils towards the electron gun. A pair of centering magnets 3 are provided on cover 4 which covers the sub-deflecting coil. The deflection yoke is fastened to CRT 6 with metallic fastening band 5 attached to the cover 4. CRT 6 has straight portion 6*a* towards the electron gun and substantially-conical portion 6*b* towards a screen surface.

FIG. 2 shows an operation of the deflection yoke. The deflection yoke is fitted on CRT 6, and forms horizontally and vertically deflecting fields that create a picture on the screen surface of CRT. In a projector, such as a projection type receiver and a projector, plural number of lens 7 (a single lens in FIG. 2) provided at the screen surface of CRT 6 expands a picture on the screen surface and projects picture 9 on screen 8.

FIG. 3 shows a distortion of the picture to be corrected by the sub-deflection yoke 1. The projector includes CRTs of three colors, red, green and blue, which provides a color picture by having three pictures of three colors overlap on one another. In order to having the three pictures from different angles overlap without a displacement, the sub-deflecting coil 1 corrects the position of each picture and pincushion distortion shown in FIG. 3, thereby aligning the three color pictures.

A conventional sub-deflection yoke disclosed in Utility Model Laid-Open Publication No.63-95160 and Japanese Patent Laid-Open Publication No. 3-257742 shown in FIG. 4, and an another conventional sub-deflection yoke shown in FIG. 5 include ring-shaped ferrite core 10, horizontal sub-deflecting coil 11, and vertical sub-deflecting coil 12 which are wound toroidally on core 10. Glass tube 13 of CRT passes through the center of the core 10.

FIG. 6 shows centering magnet 3 for aligning respective centers of pictures of three colors, red, green and blue on the screen 8. The paired centering magnets 3 magnetized to have two poles, N pole and S pole, are provided at the cover 4 with fitting rib 4*a* provide at the cover 4 of the deflection yoke.

FIG. 7 shows one of conventional centering magnets 3. The centering magnet 3 includes knob portion 3*b* and knob portion 3*c* on ring body 3*a*. The centering magnet 3 is magnetized to have N pole near knob portion 3*b* and S pole near knob portion 3*c*, and produces magnetic lines 14 inside the ring body 3*a*.

FIG. 8 shows the conventional centering magnets 3. The centering magnet 3 can change the strength of the magnetic lines by superposing magnetic lines 14-1 generated inside ring body 3*a*-1 on magnetic lines 14-2 generated inside ring body 3*a*-2, and change the direction of the magnetic line by rotating the centering magnets.

The centering magnet disclosed in Japanese Patent Laid-open Publication No. 2002-75250 is manufactured by injection-molding of plastic resin mixed with ferromagnetic material powder, and then polarizing it. The ferromagnetic material powder may include Alnico-based metal, which has a coercive force of magnetic lines varying little according to a temperature.

FIG. 9 shows a conventional horizontal deflecting coil 101 and a conventional vertical deflecting coil 102. The horizontal deflecting coil 102 has deflection section 15 where copper wires run in parallel to a tube axis of the CRT, coil-connection-wire section 16 at a rear end towards the electron gun, and coil-connection-wire section 44 at the end towards the screen surface. In coil-connection-wire sections 16 and 44, copper wires run in a direction perpendicular to the tube axis of the CRT. Since having a direction identical to the direction of the electron beam emitted, Magnetic lines produced by the coil-connection-wire sections 16 and 44 do not contribute to a deflection of the electron beam.

FIG. 10 shows a main deflecting coil and a conventional sub-deflecting coil. Sub-deflecting coil 1 provided at the rear end of the main deflecting coil towards the electron gun receives magnetic line 17 generated by the coil-connection-wire section 16 at the electron gun side of the horizontal deflecting coil. Thus, an induced voltage is generated at the sub-deflection yoke 1, thereby causing noise in the picture.

The induced voltage that is generally called "CY cross talk" is about 19V when a voltage of 1,200V is applied to the horizontal deflecting coil. The vertical deflecting coil 31 has a similar coil-connection-wire section 103. But, the voltage applied to the vertical deflecting coil does not exceed 100V, and thus does not generate magnetic lines from the vertical deflecting coil to induce a voltage generating the noise.

When the correction of the screen position is not necessary, conventional centering magnets 3 inversely superpose the magnetic lines 14-1 generated inside the ring body 3*a*-1 and the magnetic lines 14-2 generated inside the ring body 3*a*-2 for canceling the lines, as shown in FIG. 8, thereby creating no magnetic line inside the ring body. However, it is practically difficult to completely eliminate the magnetic lines inside the ring body by superposing the centering magnets for the following reason.

FIG. 11 shows directions of resin that flows during the injection molding of the centering magnet. FIG. 12 shows the magnetic lines in the conventional centering magnet. As shown in FIG. 11, plastic resin mixed with ferromagnetic powder flows from port 18 along a direction of arrow 19 and reaches the knob portion 3*c* at a side opposite to the port 18. Alnico resin powder has a grain size of about 90 μm and is heavier than the resin. The resin including the ferromagnetic material powder at a higher density has a smaller viscosity, thus flowing more easily. Accordingly, the ferromagnetic material powder of high density gathers at the knob portion 3*c* at the side opposite to the gate 18. Upon such centering magnet being polarized, the magnetic lines is strong at a portion near the knob portion 3*c*, as shown in FIG. 12, including a high density of the ferromagnetic material powder.

FIG. 13 and FIG. 14 show the magnetic lines created by the conventional centering magnet. Even if the knob portions 3*b* and 3*c* of the magnets having magnetic lines asymmetrical to each other as described above are placed one on another for canceling the magnetic lines, their internal magnetic lines are not completely canceled and remains a 4-pole magnetic field. Accordingly, as shown in FIG. 14, electron beam 20 passing through the interior of the centering magnet receives force 22 due to the magnetic line 21 and thus has a spot deform into an oval shape, thus causing deterioration of a focus on the screen.

SUMMARY OF THE INVENTION

A deflection yoke is used for a cathode ray tube (CRT) including a glass tube having a screen surface and a straight portion for accommodating an electron gun. The deflection yoke includes a main deflection yoke including first and second horizontal deflecting coils and first and second vertical deflecting coils, and a sub-deflection yoke provided at a side of the main deflection yoke towards the electron gun of the CRT. The first and second horizontal deflecting coils have substantially saddle shapes and includes first and second coil-connection-wire sections and first and second horizontal deflection sections, respectively. The first and second coil-connection-wire sections are wound in a direction perpendicular to a tube axis of the CRT and along the straight portion, respectively. The first and second horizontal deflection sections are located towards the screen surface from the first and the second coil-connection-wire sections, respectively.

In the deflection yoke, magnetic lines emitted from a rear end of the horizontal deflecting coil towards the electron gun decreases. An induced voltage generated at the sub-deflection yoke accordingly decreases, and thus, a noise on a screen noise produced due to the induced voltage is reduced.

DESCRIPTION OF THE PREFERRED EMBODIMENT

Exemplary Embodiment 1

Figure 15:
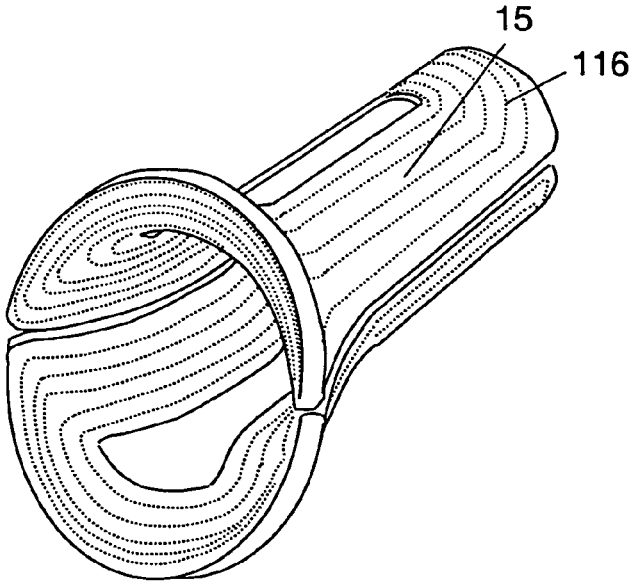
FIG. 15 is a perspective view of a horizontal deflecting coil according to Exemplary Embodiment 1 of the present invention.
Figure 16:
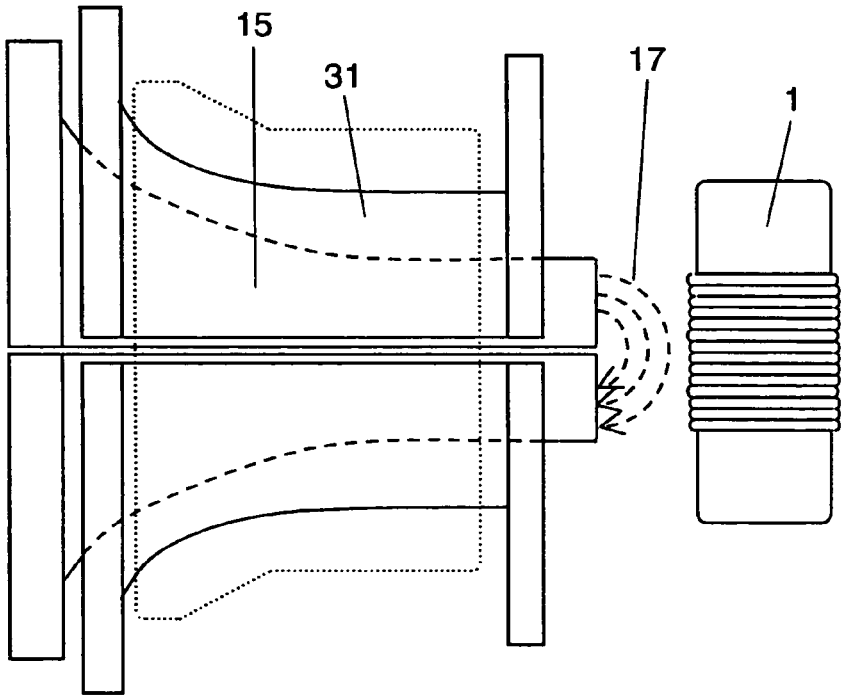
FIG. 16 shows a horizontal deflecting coil and sub-deflecting coil of Embodiment 1.
Figure 46:
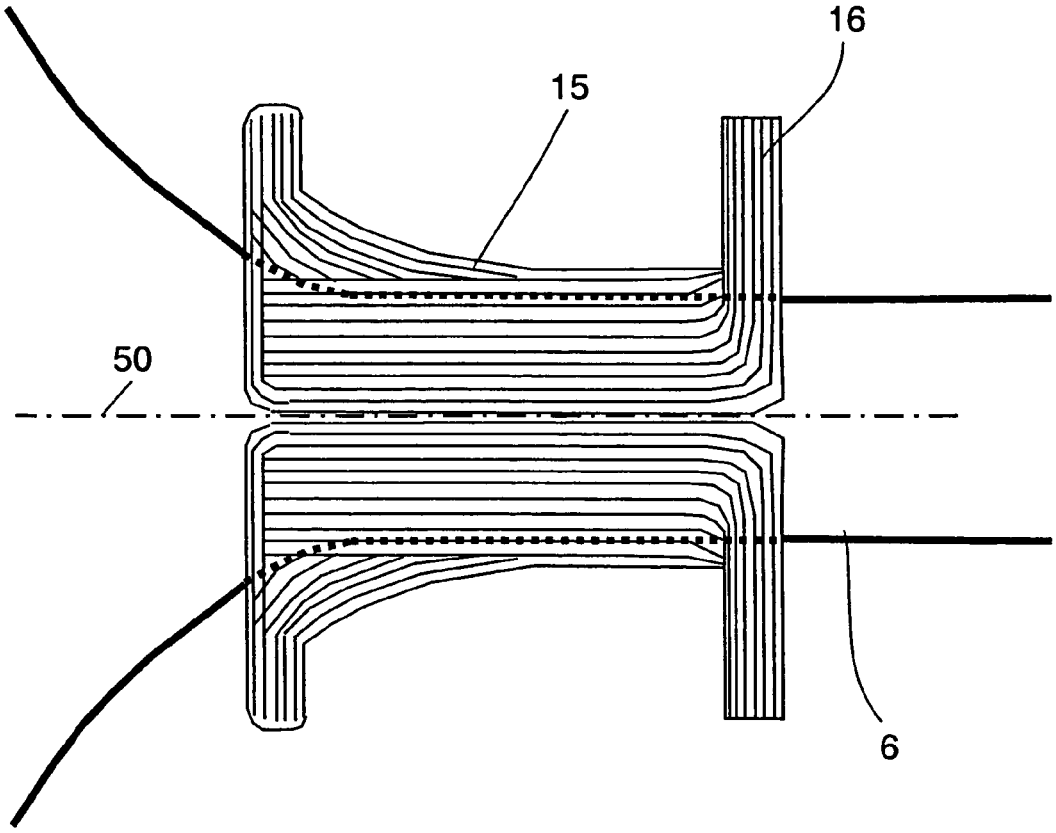
FIG. 46 shows a conventional horizontal deflecting coil and a cathode ray tube (CRT).
Figure 47:
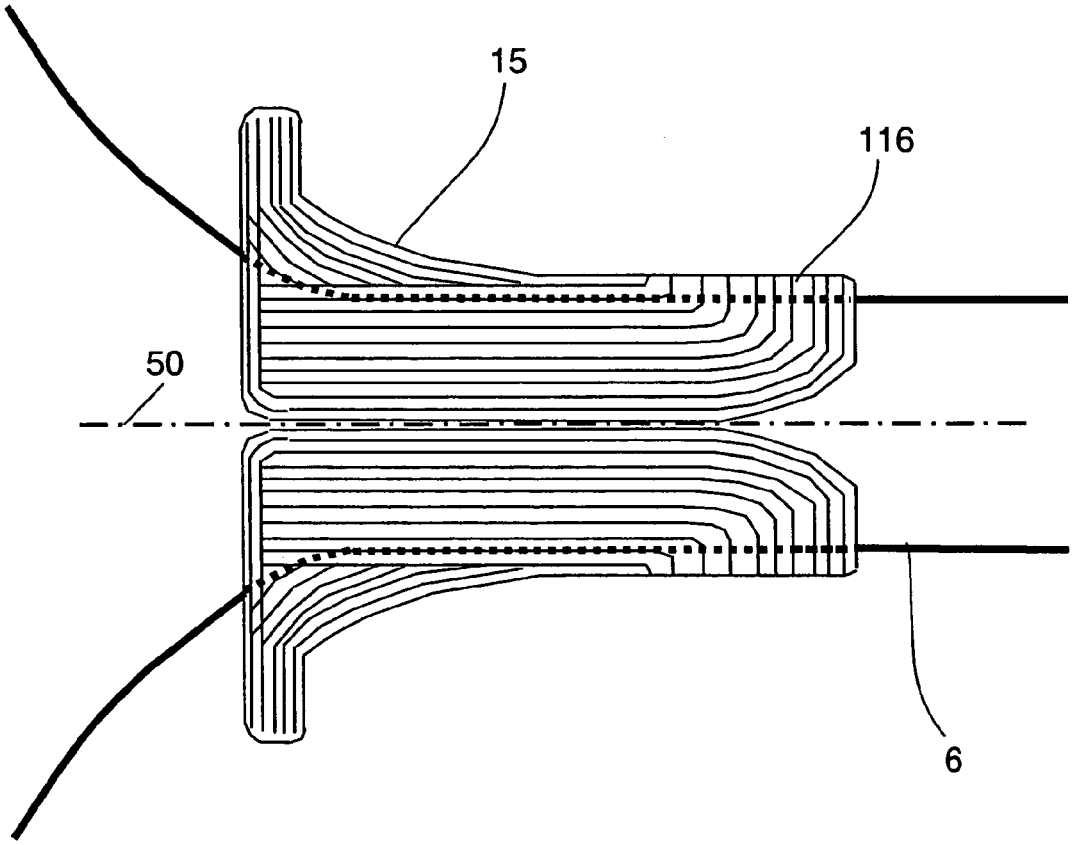
FIG. 47 shows a horizontal deflecting coil and a CRT according to Embodiment 1.

FIG. 15 is a perspective view of a horizontal deflecting coil according to Exemplary Embodiment 1 of the present invention. FIG. 16 shows a main deflecting coil and a sub-deflecting coil of Embodiment 1. FIG. 46 shows an arrangement of a conventional deflecting coil and a cathode ray tube (CRT). FIG. 47 shows an arrangement of a horizontal deflecting coil and a CRT of Embodiment 1.

In order to decrease a voltage (generally called CY cross talk) induced at the sub-deflection yoke by magnetic lines from the horizontal deflecting coil having substantially a saddle shape of a main deflecting coil, it is necessary to keep the sub-deflection yoke away from the main deflection yoke. However, increasing a space between the sub-deflection yoke and the main deflection yoke results in an increasing of the overall length of the deflection yoke. It is difficult to increase the overall length of the deflection yoke because of a physical interference with other parts, such as a velocity modulation coil mounted to a rear portion of the deflection yoke towards an electron gun. Therefore, the distance between the sub-deflection yoke and the main deflection yoke cannot be increased.

Figure 9:
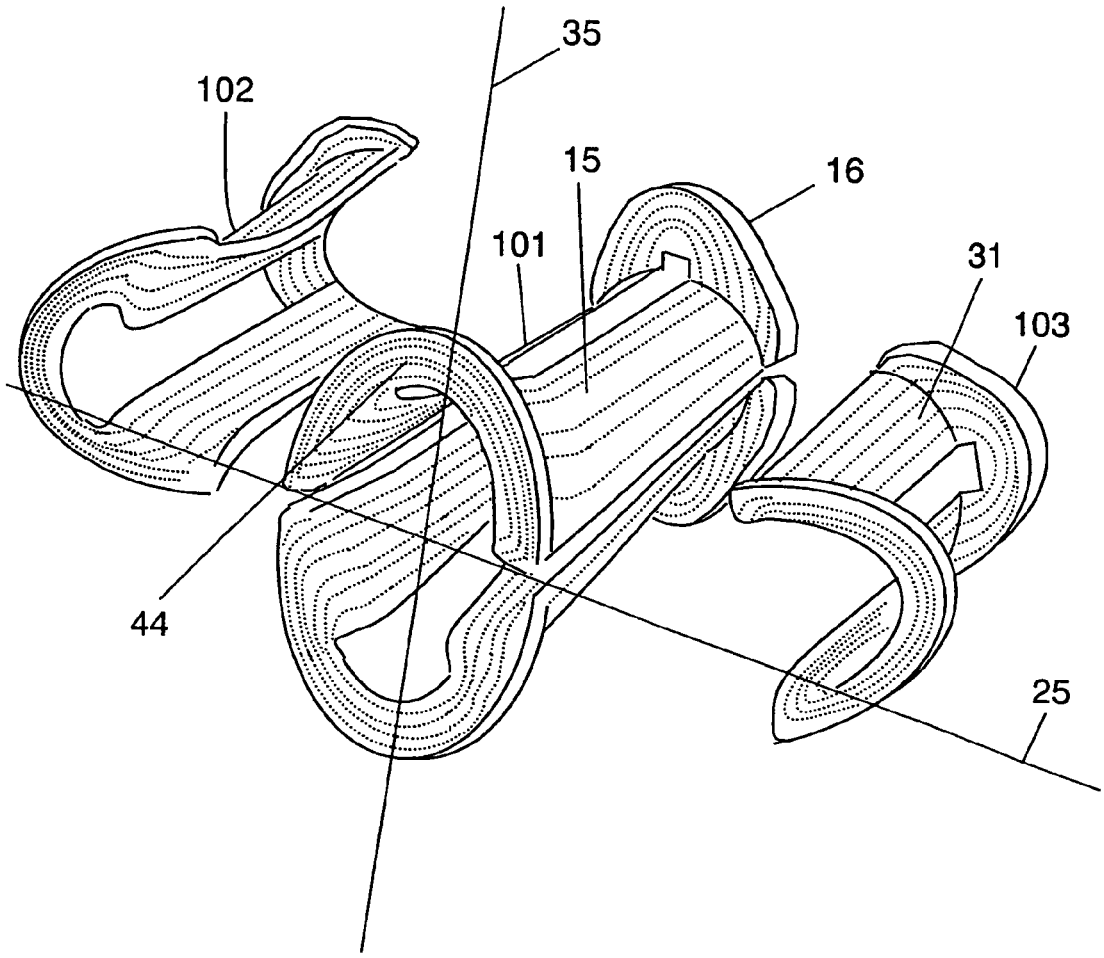
FIG. 9 shows a conventional horizontal deflecting coil and a conventional vertical deflecting coil.
Figure 10:
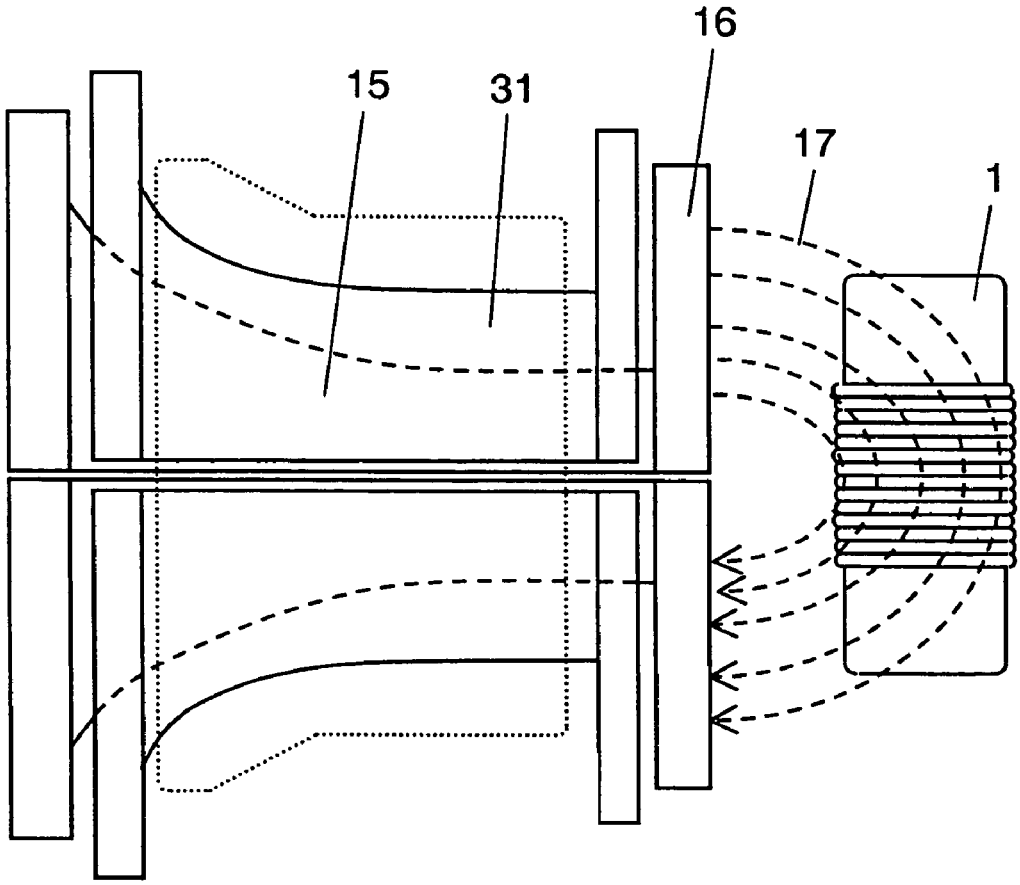
FIG. 10 shows a conventional main deflecting coil and a conventional sub-deflecting coil.
Figure 11:
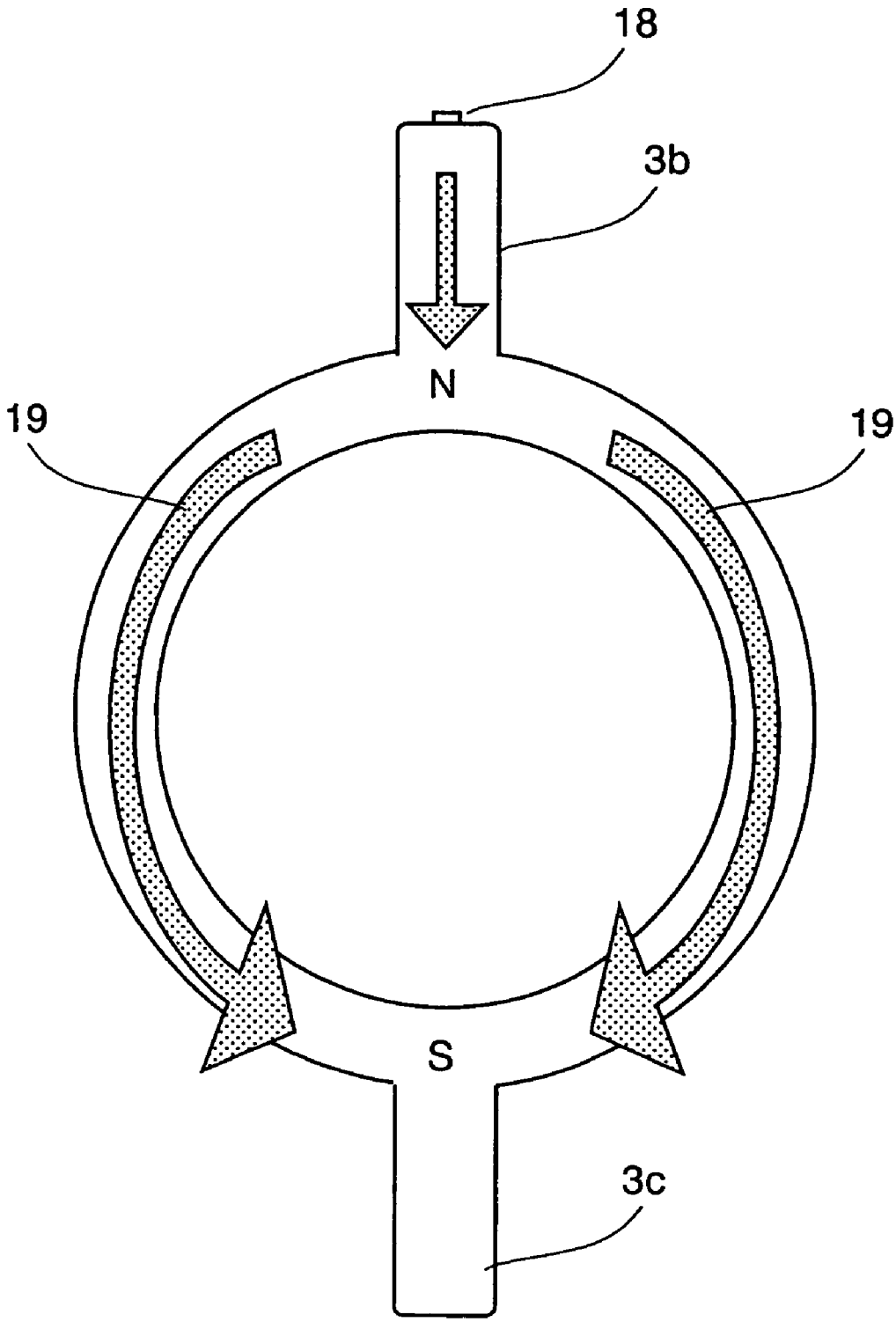
FIG. 11 shows a direction of a flow of resin during production of a conventional centering magnet.
Figure 12:
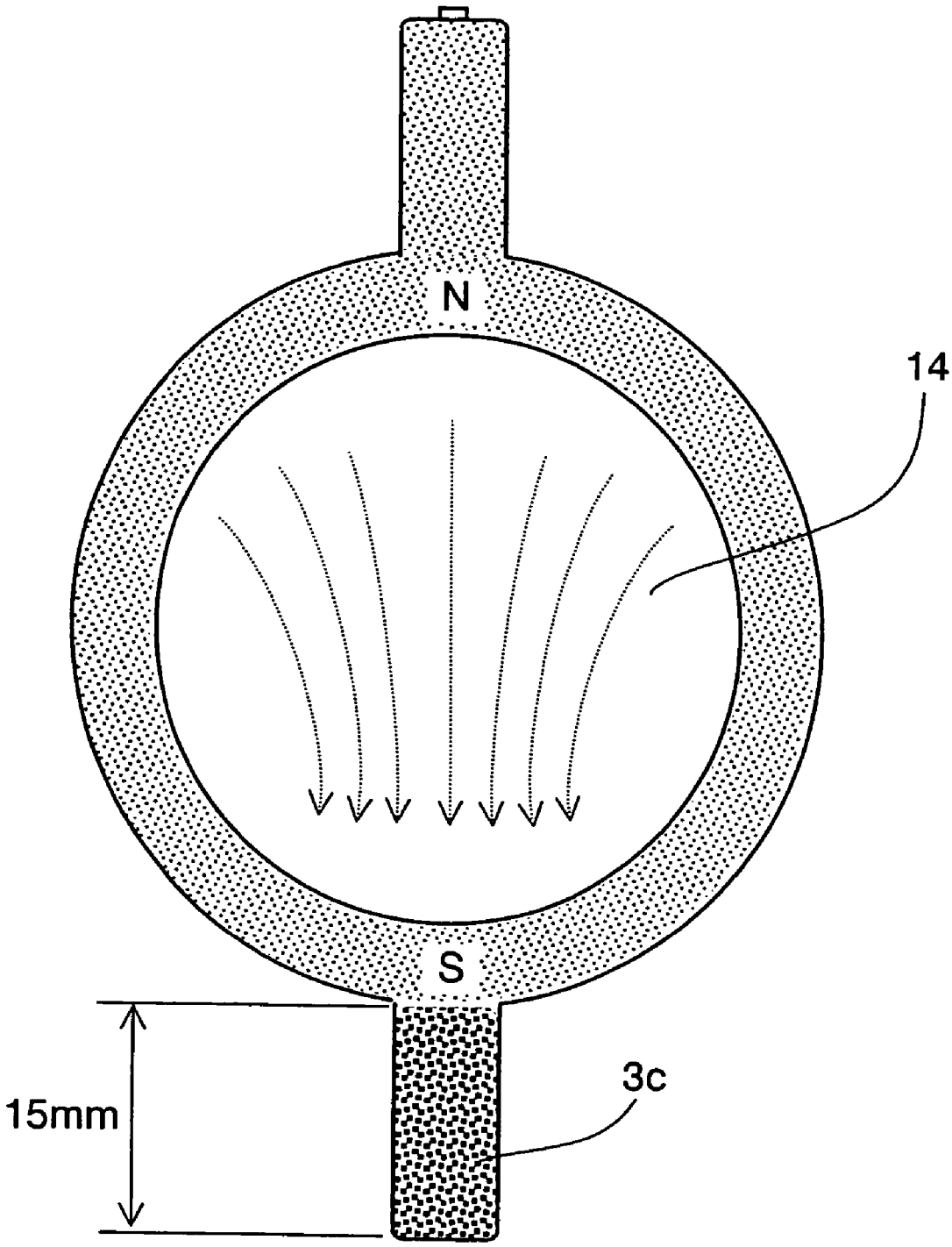
FIG. 12 shows magnetic lines generated by a conventional centering magnet.
Figure 13:
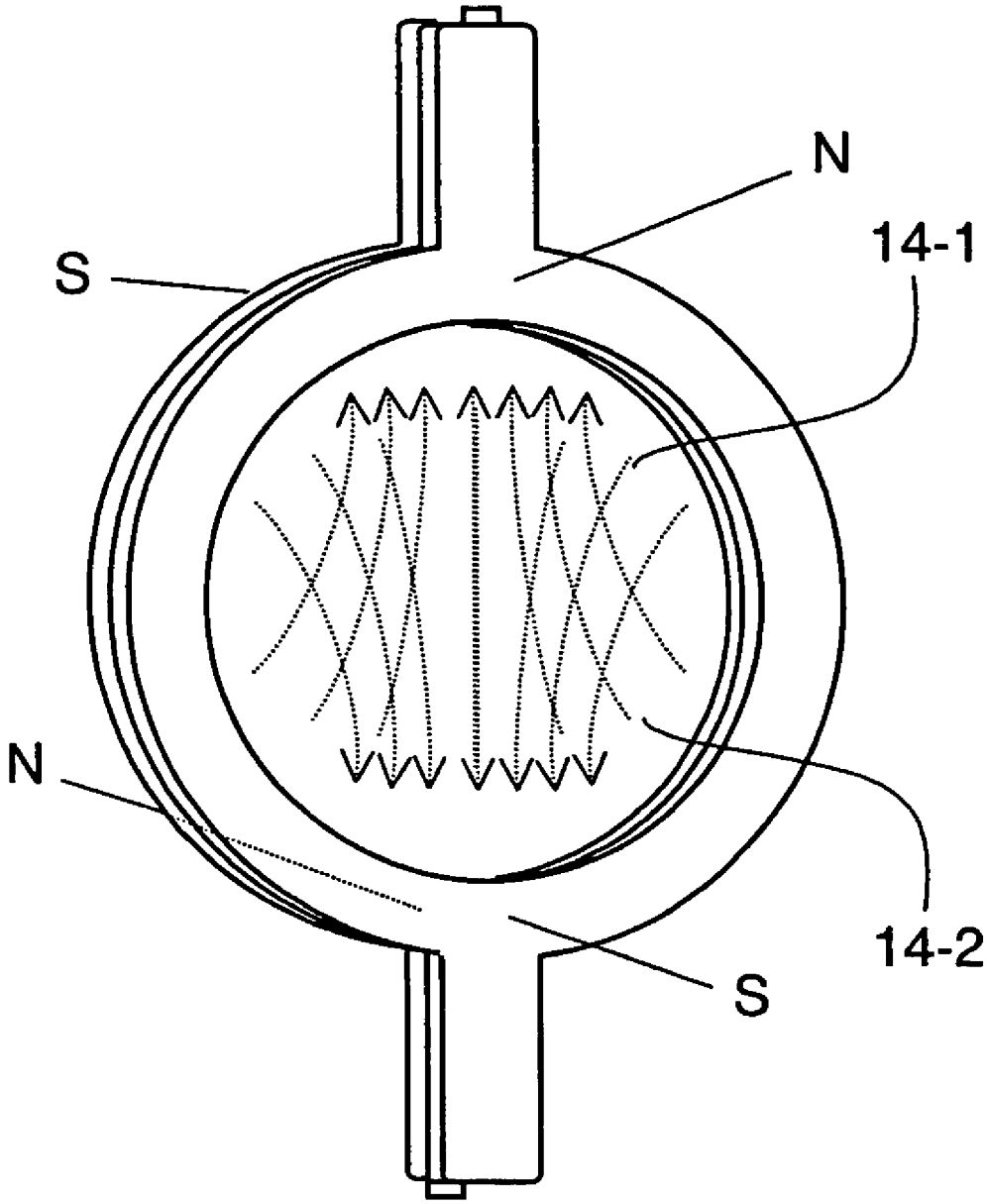
FIG. 13 shows magnetic lines generated by the conventional centering magnet.
Figure 14:
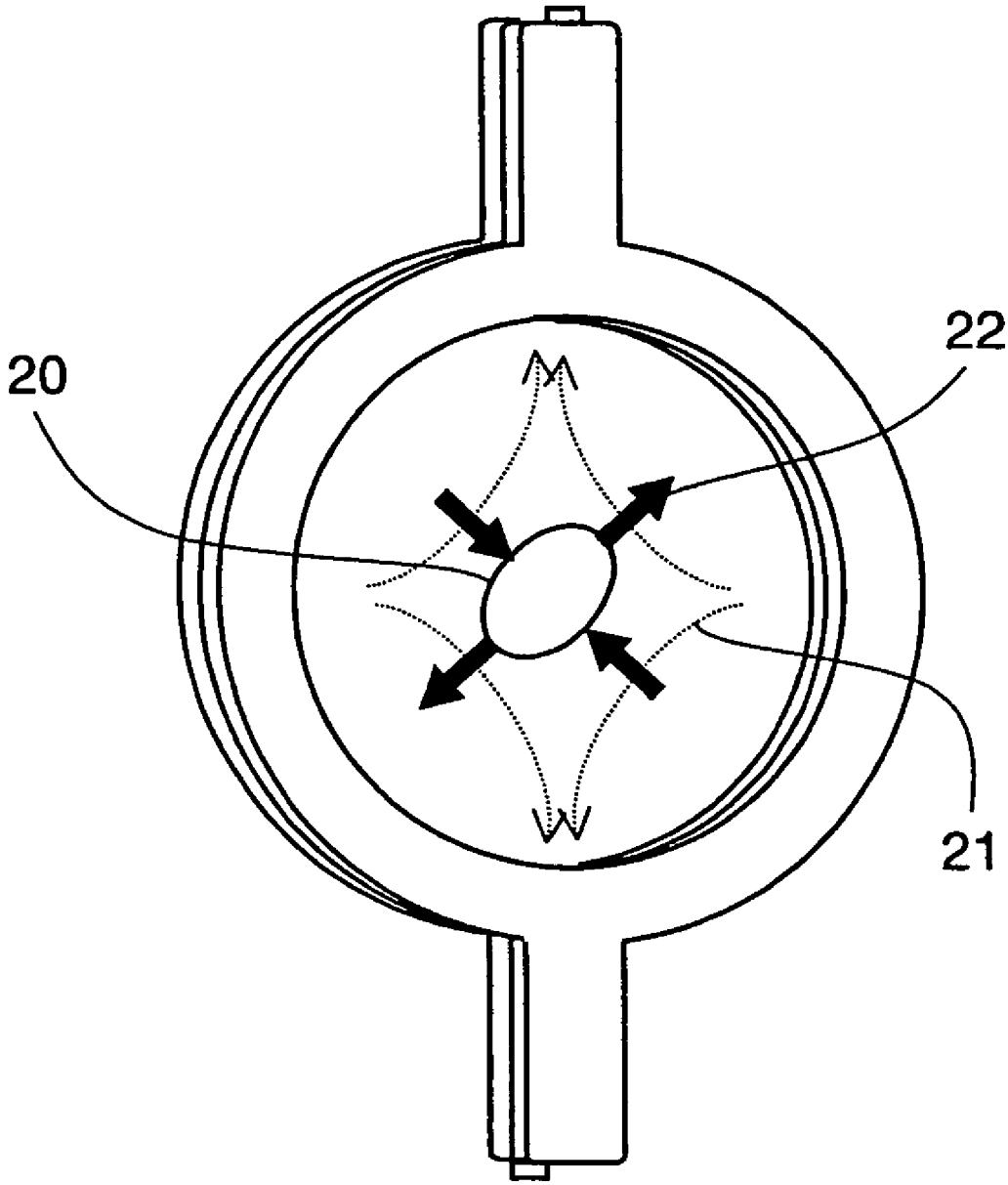
FIG. 14 shows magnetic lines generated by the conventional centering magnet.

In conventional horizontal deflecting coil 15, as shown in FIG. 46, coil-connection-wire section 16 at a rear end of the coil 15 towards an electron gun has a shape (bent-up shape) bent up perpendicularly to tube axis 50 of a CRT. Thus, the coil-connection-wire section 16 emits magnetic lines backward. In the deflection yoke of Embodiment 1, as shown in FIG. 15 and FIG. 47, coil-connection-wire section 116 at an end of a horizontal deflecting coils towards an electron gun is wound in a direction along a straight portion towards the electron gun of the CRT. Since a turned-up portion of coil-connection-wire section 16 shown in FIG. 9 is eliminated, magnetic lines 17 emitted from the rear end of the horizontal deflecting coil towards the electron gun can decrease. Accordingly, the magnetic lines received by sub-deflecting coil 1 can be reduced, keeping the overall length identical to that of the conventional deflecting coil.

Regarding an amount of the CY cross talk (induced voltage), when a voltage of 1,200V is applied to a horizontal deflecting coil of the conventional deflection yoke, the induced voltage ranges from 17V to 19V, while the induced voltage of the deflection yoke of Embodiment 1 ranges from 2V to 4V, which is lower than that of the conventional deflection yoke. Accordingly, the deflection yoke of Embodiment 1 can reduce a noise on a screen caused by the induced voltage.

Exemplary Embodiment 2

Figure 49:
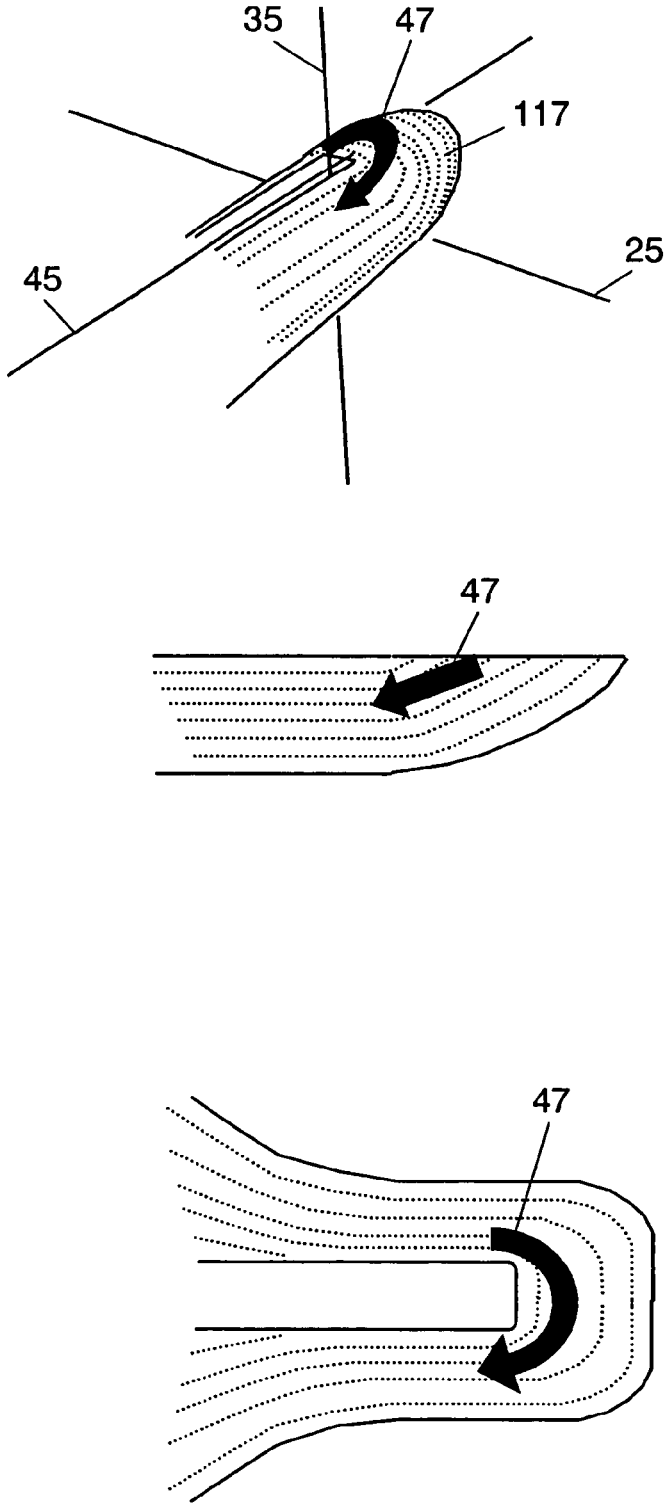
FIG. 49 shows a winding direction of a coil-connection-wire section at a rear end of the horizontal deflecting coil towards an electron gun according to Embodiment 2.
Figure 50:
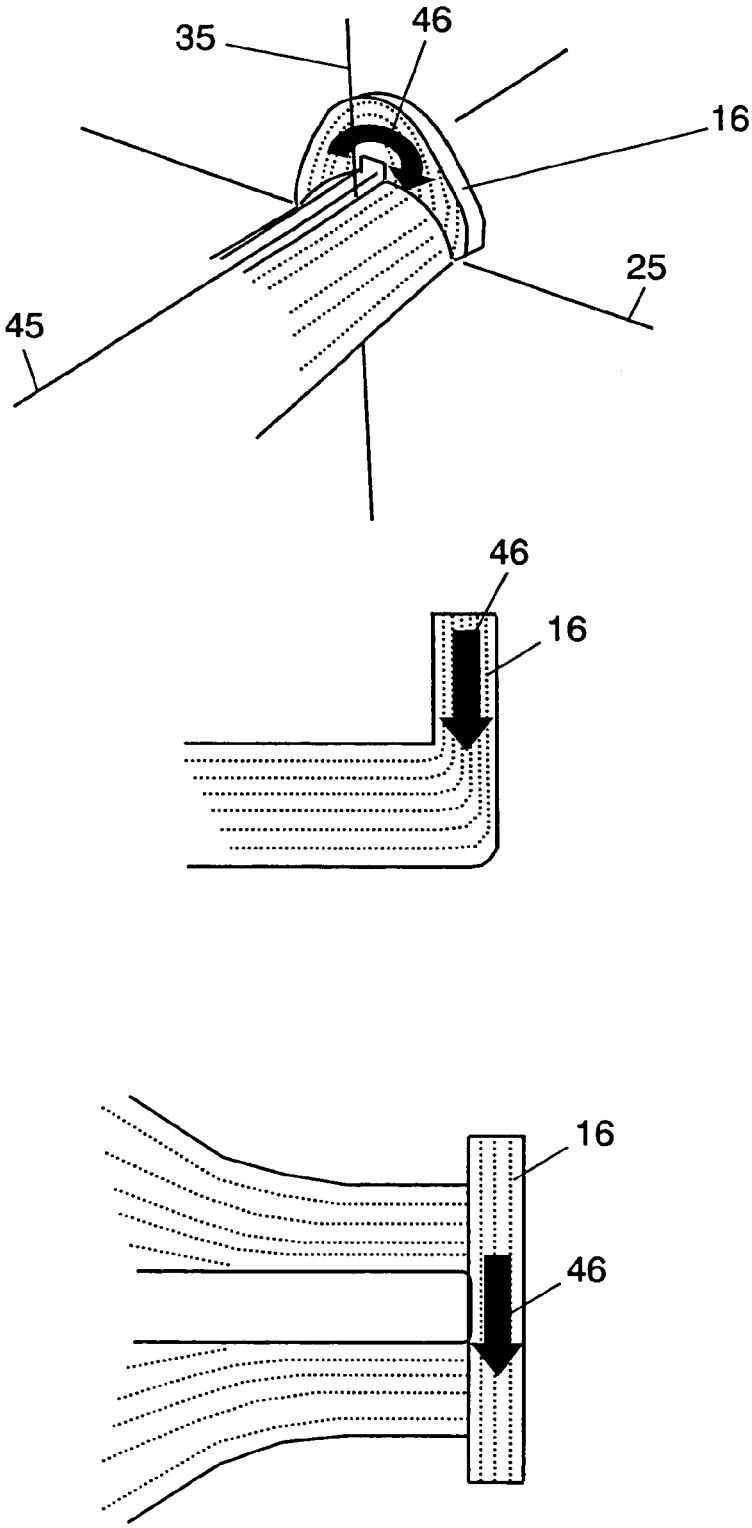
FIG. 50 shows a winding direction of a coil-connection-wire section towards an electron gun of the conventional horizontal deflecting coil.

FIG. 49 shows coil-connection-wire section 117 at a side of a horizontal deflecting coil towards an electron gun according to Exemplary Embodiment 2 of the present invention. FIG. 50 shows coil-connection-wire section 16 at a side of a conventional deflecting coil towards an electron gun.

As shown in FIG. 50, coil-connection-wire section 16 of a conventional deflecting coil is semi-circularly wound about axis 45 parallel with a tube axis of a CRT in direction 46 so that the portion 16 is piled up in a direction of axis 35 perpendicular to the tube axis.

In the horizontal deflecting coil according to Embodiment 2, as shown in FIG. 49, coil-connection-wire section 117 is semi-circularly wound about axis 35 perpendicular to the tube axis of a CRT in direction 47 so that the portion 117 is piled up in a direction of axis 45 parallel with the tube axis.

Exemplary Embodiment 3

Figure 17:
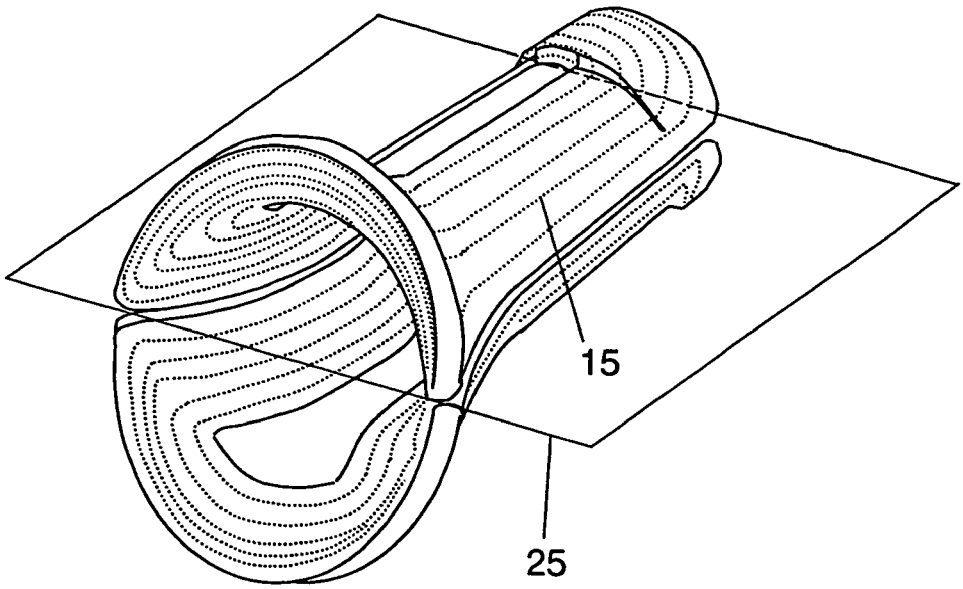
FIG. 17 is a perspective view of a horizontal deflecting coil according to Exemplary Embodiment 3 of the invention.
Figure 18:
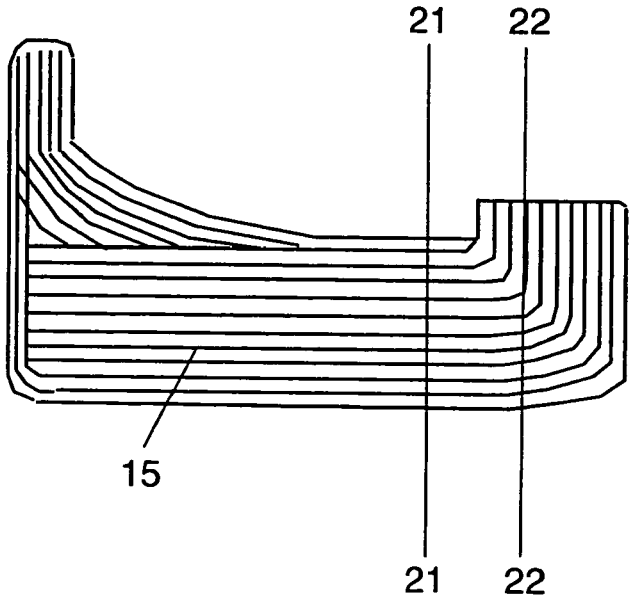
FIG. 18 is a plan view of the horizontal deflecting coil according to Embodiment 3.
Figure 19:
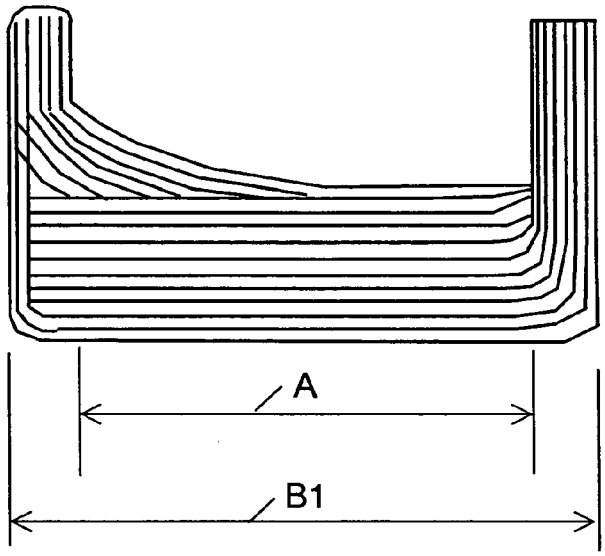
FIG. 19 is a side view of a conventional horizontal deflecting coil.
Figure 20:
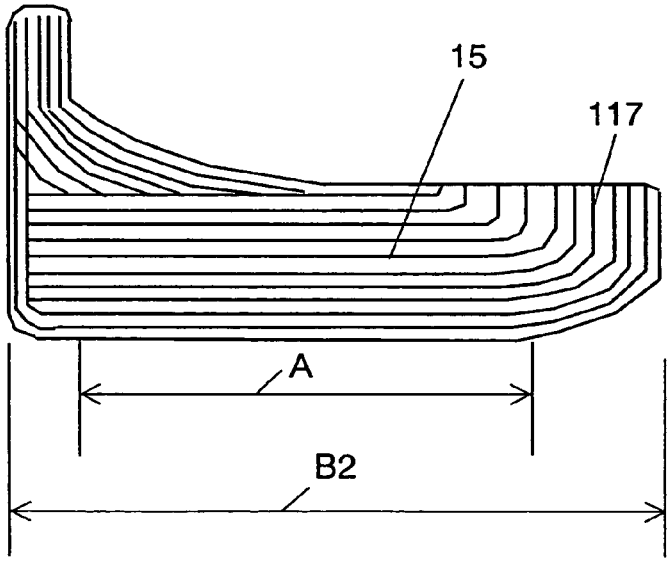
FIG. 20 is a side view of a horizontal deflecting coil according to Embodiment 2.

FIG. 17 is a perspective view of a pair of horizontal deflecting coils according to Exemplary Embodiment 3 of the present invention. FIG. 18 is a side view of a horizontal deflecting coil according to Embodiment 3. FIG. 9 shows a conventional horizontal deflecting coil and a conventional vertical deflecting coil. FIG. 19 is a side view of the conventional horizontal deflecting coil. FIG. 20 is a side view of a horizontal deflecting coil according to Embodiment 2.

As shown in FIG. 9, conventional horizontal deflecting coil 15 has coil-connection-wire section 16 at a side of the coil 15 towards an electron gun. As shown in FIG. 19, the horizontal deflecting coil 15 includes effective length A contributing to deflection and overall coil length B1. The effective length is the length of a portion where copper wires of the deflection yoke are wound in parallel with a tube axis of a CRT, namely, a horizontal deflection section. Since the horizontal deflecting coil of Embodiment 3 having effective length A shown in FIG. 20 is wound in straight without projecting at coil-connection-wire section 117, the coil includes overall length B2 greater than the overall length B1 of the conventional deflection yoke.

Figure 48A:
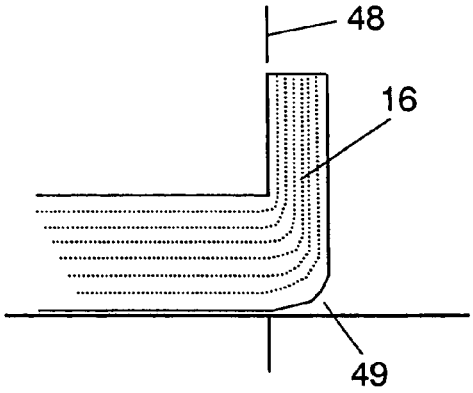
FIG. 48A is a side view of a rear end of a conventional horizontal deflecting coil towards an electron gun.
Figure 48B:
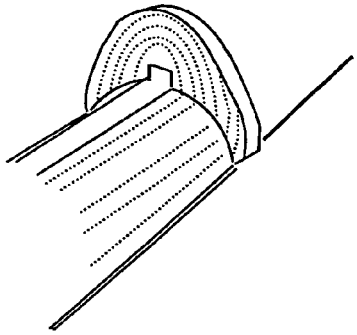
FIG. 48B is a perspective view of the rear end of a conventional horizontal deflecting coil towards at an electron gun.
Figure 48C:
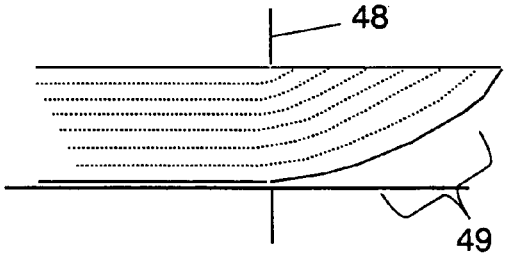
FIG. 48C is a side view of a rear end of the horizontal deflecting coil towards an electron gun according to Embodiment 2.
Figure 48D:
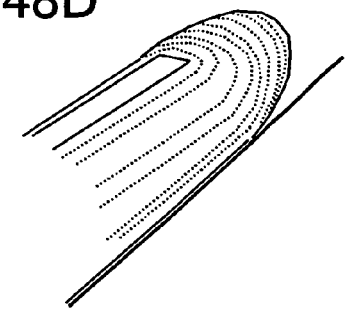
FIG. 48D is a perspective view of a rear end of the horizontal deflecting coil towards an electron gun according to Embodiment 2.
Figure 48E:
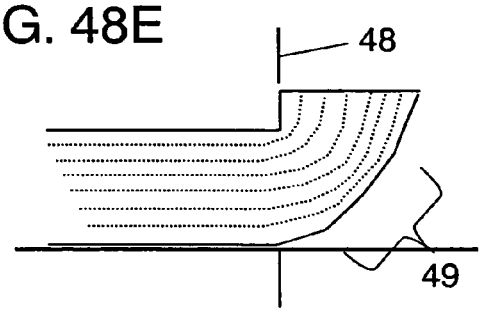
FIG. 48E is a side view of a rear end of another horizontal deflecting coil towards an electron gun.
Figure 48F:
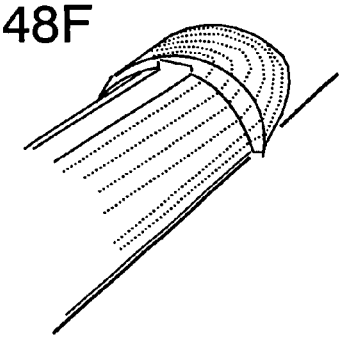
FIG. 48F is a perspective view of a rear end of another horizontal deflecting coil towards an electron gun.
Figure 48G:
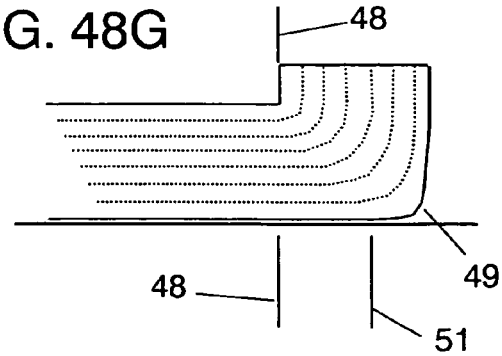
FIG. 48G is a side view of a rear end of the horizontal deflecting coil towards an electron gun according to Embodiment 3.
Figure 48H:
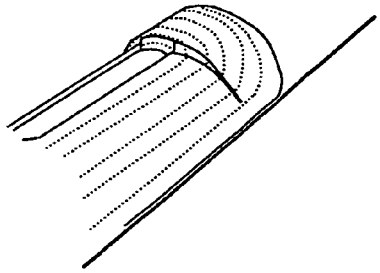
FIG. 48H is a perspective view of a rear end of the horizontal deflecting coil towards an electron gun according to Embodiment 3.

FIG. 48A is a side view of a rear end of the conventional horizontal deflecting coil towards an electron gun. FIG. 48B is a perspective view of the rear end of the conventional horizontal deflecting coil. FIG. 48C is a side view of the rear end of the horizontal deflecting coil towards an electron gun of Embodiment 2. FIG. 48D is a perspective view of the rear end of the horizontal deflecting coil of Embodiment 2. FIG. 48E is a side view of a rear end of another horizontal deflecting coil towards an electron gun. FIG. 48F is a perspective view of the rear end of another horizontal deflecting coil. FIG. 48G is a side view of a rear end of a horizontal deflecting coil towards an electron gun of Embodiment 3. FIG. 48H is a perspective view of the rear end of the horizontal deflecting coil of Embodiment 3.

As shown in FIG. 48A and FIG. 48B, the coil-connection-wire section 16 of a conventional horizontal deflecting coil is bent at rear end 48 of its effective length towards the electron gun to form a bend-up shape. In the horizontal deflecting coil according to Embodiments 1 and 2, as shown in FIG. 48C and FIG. 48D, the total length of the horizontal deflecting coil is greater since the coil-connection-wire section at the side towards the electron gun is piled up towards the electron gun. That is, in the deflecting coil of Embodiments 1 and 2, the rear end 48 of the effective length is located at a position identical to that of the conventional deflecting coil, but the rear end of the coil towards the electron gun extends backward.

As shown in FIG. 48E and FIG. 48F, the overall length of the coil ca be greater than the deflecting coil shown in FIG. 48C and FIG. 48D by having the exterior of the coil-connection-wire section projecting from the deflecting coil. However, even the overall length of the deflecting coil shown in FIG. 48E and FIG. 48F cannot be identical to that of the conventional deflecting coil shown in FIG. 48A and FIG. 48B. That is, since corner 49 of the rear end of the coil-connection-wire section of the horizontal deflecting coil shown in FIG. 48E and FIG. 48F is arcuate, the overall length of the coil is greater than that of the conventional coil even if the effective length of the coil is the same as that of the conventional coil.

Figure 21:
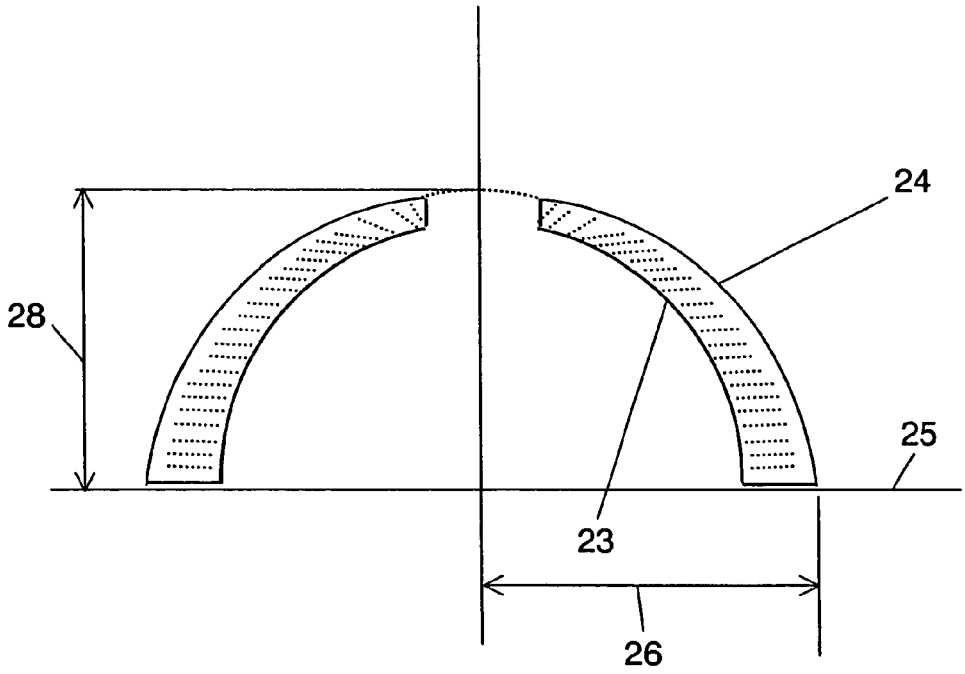
FIG. 21 is a sectional view of the horizontal deflecting coil according to Embodiment 3.
Figure 22:
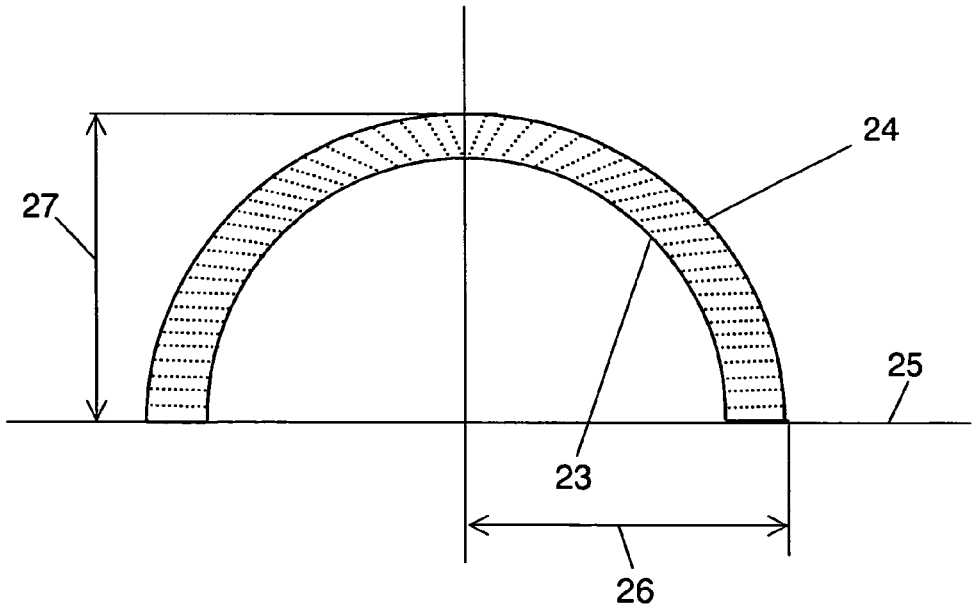
FIG. 22 is a sectional view of the horizontal deflecting coil according to Embodiment 3.

FIG. 21 is a sectional view at line 21—21 of the horizontal deflecting coil shown in FIG. 18 according to Embodiment 3. FIG. 22 is a sectional view at line 22—22 of the horizontal deflecting coil.

As shown in FIGS. 17, 18, 21, and 22, the coil-connection-wire section of the horizontal deflecting coil of Embodiment 3 has curved surface 23 facing the CRT, and curved surface 24 opposed to the surface 23, i.e., facing a vertical deflecting coil. A pair of horizontal deflecting coils face each other about plane 25. Curved surface 24 of the horizontal deflecting coil on the plane 25 towards a screen surface shown in FIG. 21 has a diameter 26 identical to the diameter of the coil-connection-wire section shown in FIG. 22. Outer diameter 27 in a direction perpendicular to the plane 25 of the coil-connection-wire section of the horizontal deflecting coil shown in FIG. 22 is greater than the outer diameter 28 of the horizontal deflecting coil shown in FIG. 21. The diameter 27 ranges from 1.05 to 1.35 times greater than the diameter 28.

This shape shown in FIG. 48G and FIG. 48H allows corner 49 of the rear end of the horizontal deflecting coil towards the electron gun to be shaped in small arc, and the rear end of the effective length of the coil extends to position 51. As a result, the overall length of the defecting coil of Embodiment 3 has the effective length identical to that of the conventional deflecting coil, while the overall length of the deflection coil is not greater than that of the conventional deflecting coil. The coil-connection-wire section of the deflecting coil at the side towards the electron can be wound in a direction along CRT according to Embodiment 3.

Exemplary Embodiment 4

Figure 23:
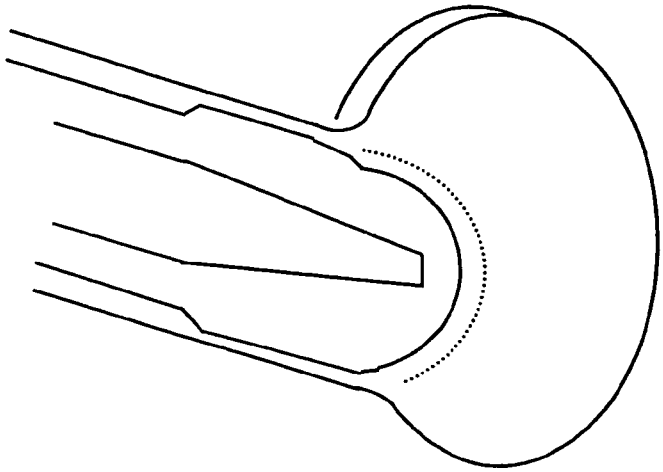
FIG. 23 is a perspective view of a vertical deflecting coil according to Exemplary Embodiment 4 of the invention.
Figure 24:
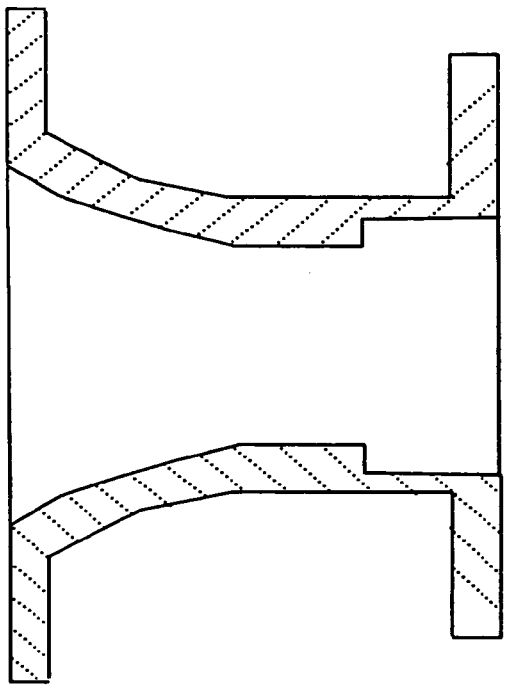
FIG. 24 is a side view of the vertical deflecting coil according to Embodiment 4.
Figure 25A:
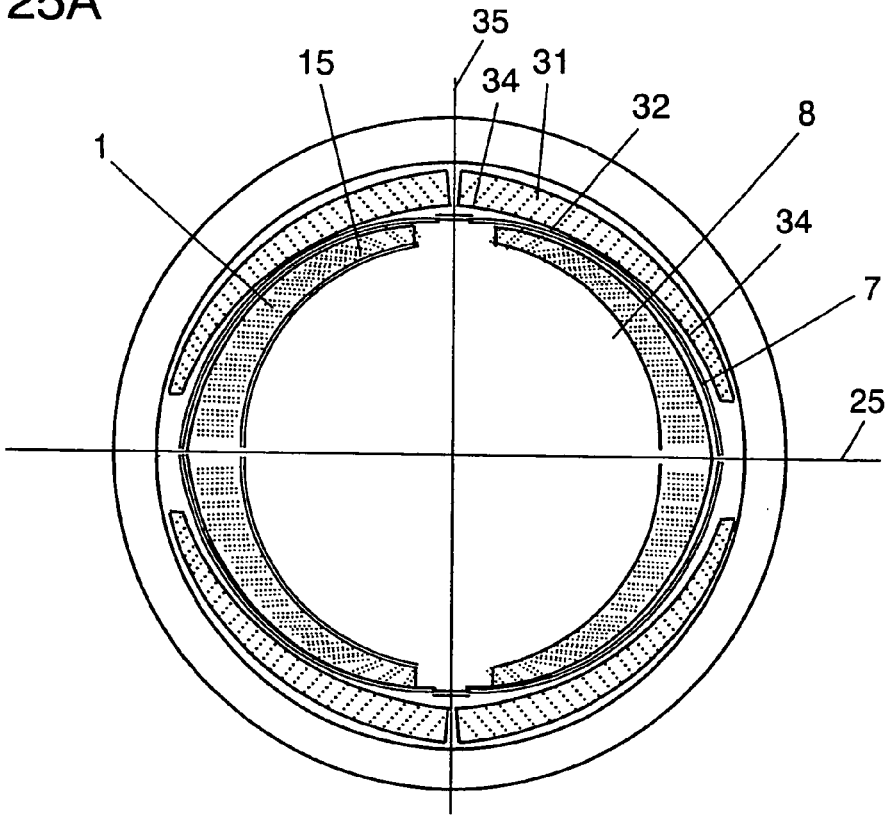
FIG. 25A and FIG. 25B are sectional views of a deflection yoke according to Exemplary Embodiment 4 of the invention.
Figure 25B:
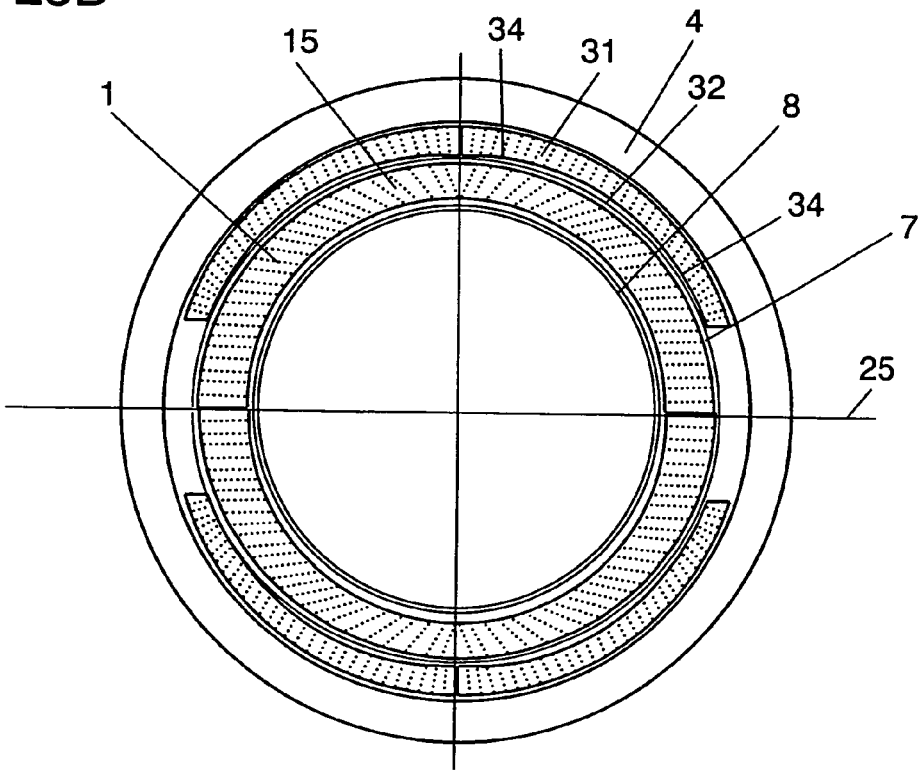
Figure 26:
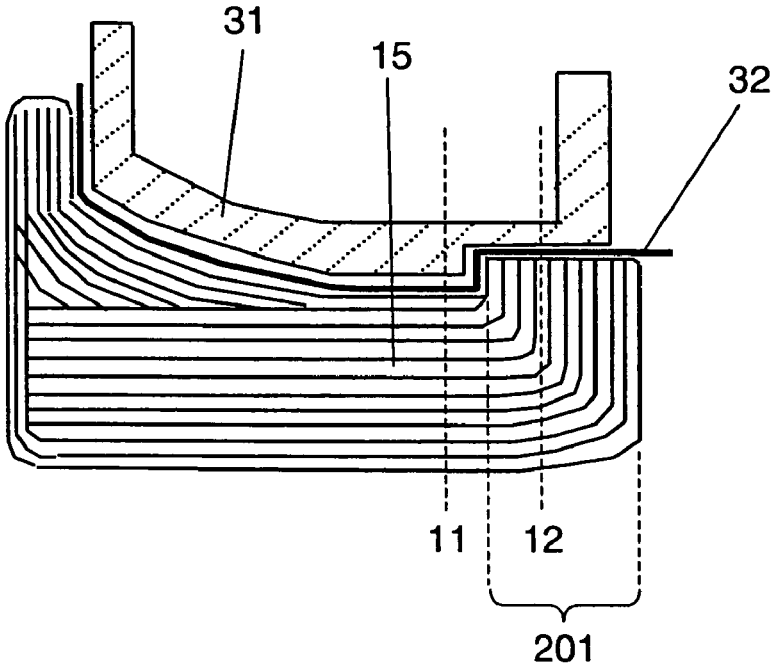
FIG. 26 is a sectional view of a deflection yoke according to Embodiment 4.

FIG. 23 is a perspective view of a rear end of a vertical deflecting coil towards an electron gun according to Exemplary Embodiment 4 of the present invention. FIG. 24 is a side view of the vertical deflecting coil. FIG. 25A and FIG. 25B are sectional views in a radial direction of the deflection yoke of Embodiment 4. FIG. 26 is a sectional view in a longitudinal direction of the deflection yoke.

As shown in FIGS. 9, 25, and 26, vertical deflecting coil 31 is mounted at an outer side of a horizontal deflecting coil 15, and is insulated from the horizontal deflecting coil 15 with insulating frame 32 shown in FIG. 25.

Figure 27:
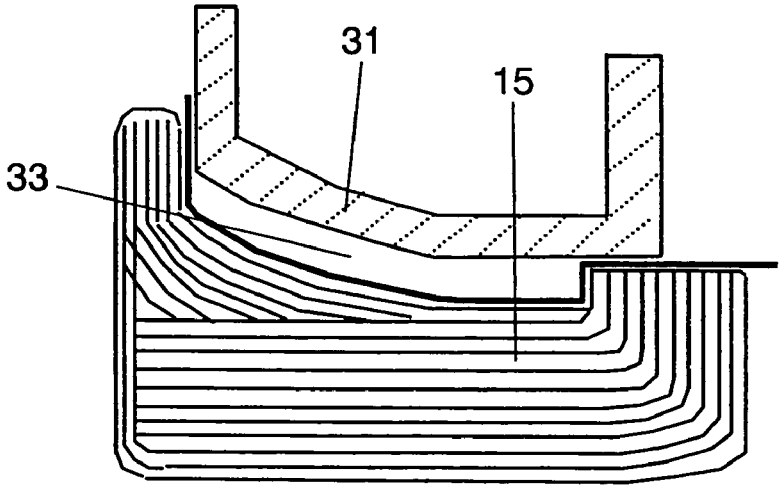
FIG. 27 is a sectional view of a deflection yoke.

In order to obtain an appropriate deflecting sensitivity of the deflection yoke, the horizontal deflecting coil, the insulating frame, the vertical deflecting coil, and a ferrite core are preferably arranged to contact each other tight without a space. The horizontal deflecting coil of Embodiment 3 shown in FIGS. 17 and 18 having an overall length identical to that of the conventional horizontal deflecting coil shown in FIG. 9 is combined with the conventional deflecting coil 31, as shown in FIG. 27. This arrangement creates space 33 between the horizontal deflecting coil 15 and the vertical deflecting coil 31, thus causing the sensitivity of the deflection yoke to decrease.

In a deflection yoke of Embodiment 4, as shown in FIGS. 25A, 25B, and 26, a diameter of curved surface 34, on plane 35, of the vertical deflecting coil 31 facing the CRT gradually decreases from the screen surface of the CRT toward the electron gun. The diameter increases at a portion close to a rear end of the vertical deflecting coil towards the electron gun. The portion where the diameter increases is combined with portion 201 where the outer diameter of the coil-connection-wire section of the horizontal deflecting coil 15 of Embodiment 3 increases, while the insulating frame is located between the coils. This arrangement creates no excessive space between the horizontal deflecting coil 15 and the vertical deflecting coil 31, thus providing a deflection yoke having a large deflecting sensitivity.

Exemplary Embodiment 5

Figure 28:
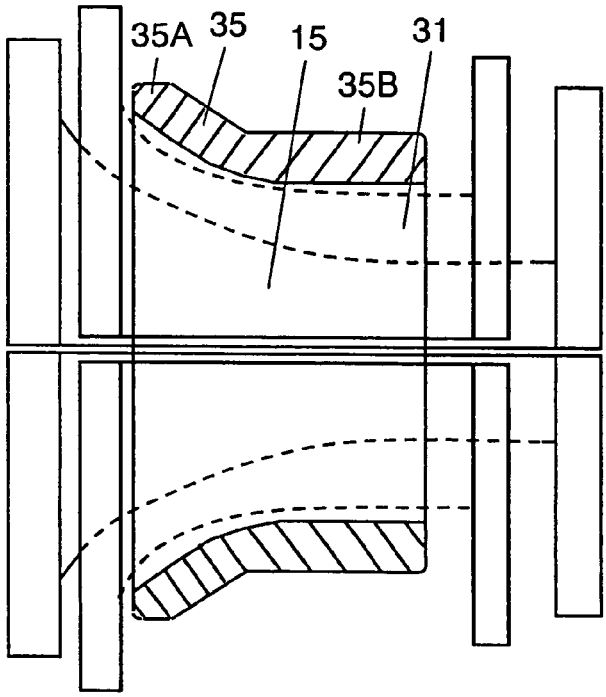
FIG. 28 shows a ferrite core of a conventional deflection yoke.
Figure 29:
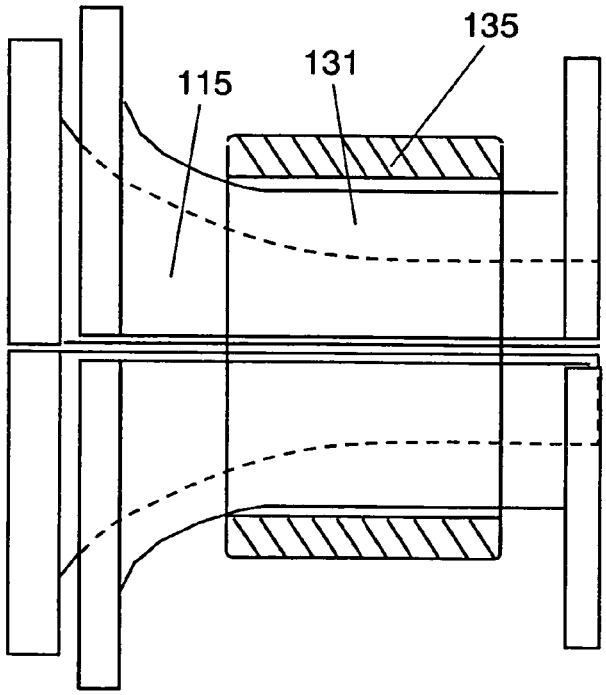
FIG. 29 shows a ferrite core of a deflection yoke according to Embodiment 5.

FIG. 28 shows a position and a sectional shape of ferrite core 35 of a conventional deflection yoke. FIG. 29 shows a position and a sectional shape of ferrite core 135 of a deflection yoke according to Exemplary Embodiment 5 of the present invention.

The ferrite core 135 (35) is mounted on an outer surface of vertical deflecting coil 131 (31). The core collects magnetic lines created by horizontal deflecting coil 115 (15) and magnetic lines created by vertical deflecting coil 131 (31), thus strengthening the magnetic lines inside the deflection yoke. The inner shape of the ferrite core 135 (35) matches the outer surface of the vertical deflecting coil 131 (31).

In the conventional deflection yoke, as shown in FIG. 28, about a half of the inner surface of the ferrite core is curved. Therefore, an internal pressure distribution in the core becomes uneven between straight portion 35B and curved portion 35A when the ferrite core 35 is manufactured by pressing. Accordingly, the ferrite core 35 may be cracked or deform to have an oval shape during burning of the ferrite core, thereby having a reduced production yield. Further, the ferrite core 35 needs to have a sectional thickness enough to be prevented from having a bad yield, but this increases the material cost of ferrite.

The deflection yoke of Embodiment 5 including a horizontal deflecting coil and a vertical deflecting coil of Embodiments 3 and 4 includes ferrite core 135 having a inner diameter uniform over its entire length, as shown in FIG. 29. In the ferrite core 135, an internal pressure during press forming can be uniform without increasing the ferrite material, thus improving its productivity.

Exemplary Embodiment 6

Figure 30:
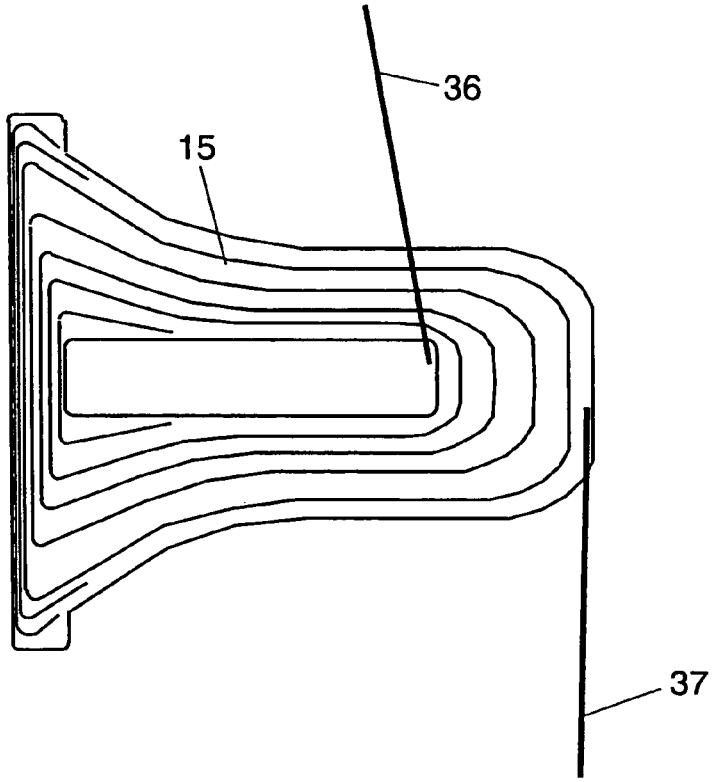
FIG. 30 is a top view of a horizontal deflecting coil according to Exemplary Embodiment 6 of the invention.
Figure 31:
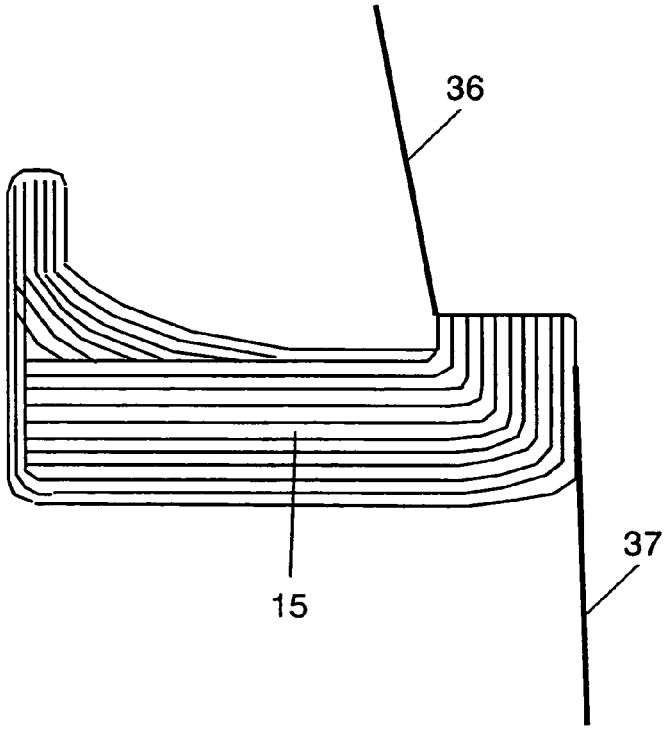
FIG. 31 is a side view of the horizontal deflecting coil according to Embodiment 6.
Figure 32:
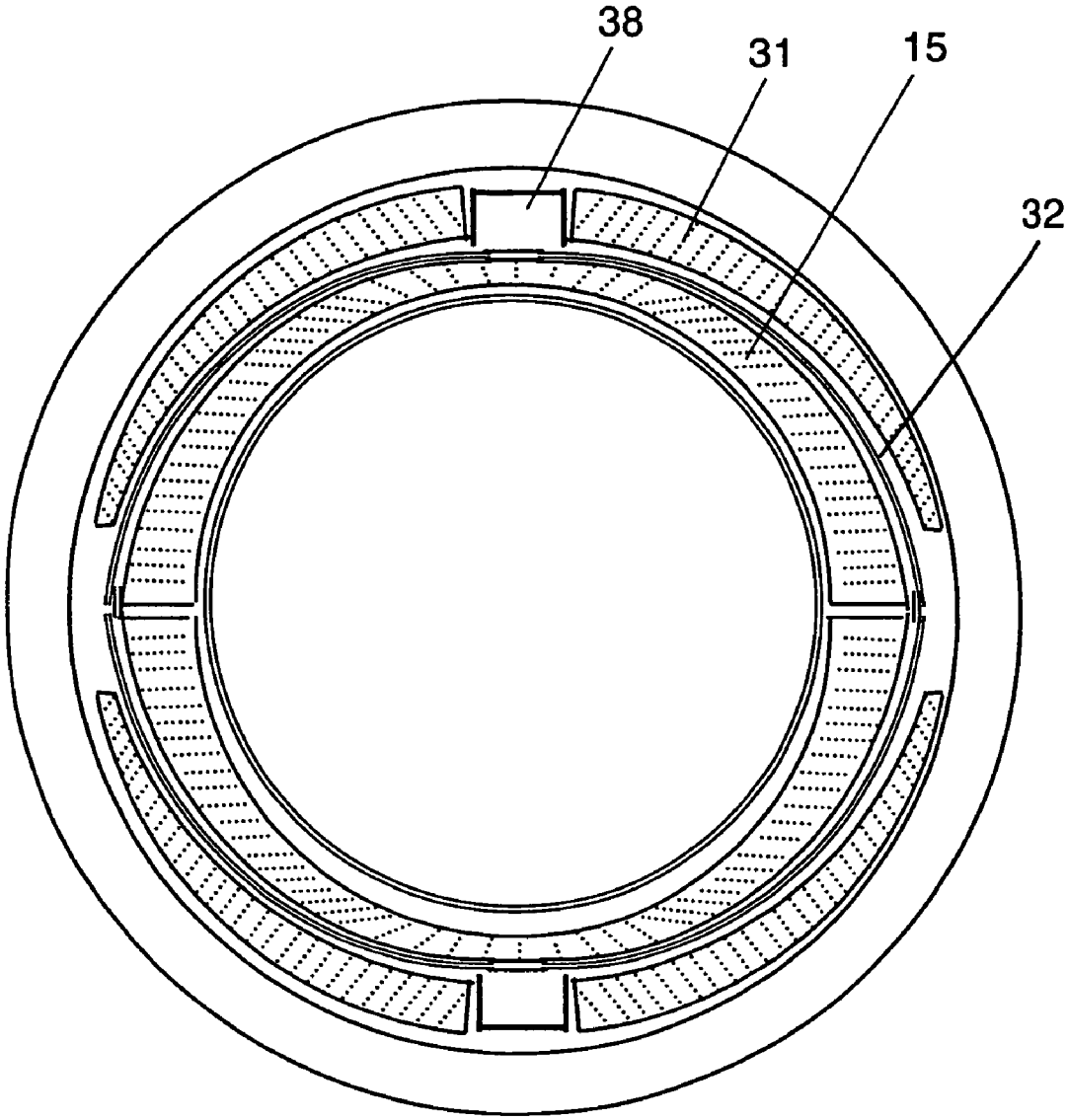
FIG. 32 is a sectional view of the horizontal deflecting coil according to Embodiment 6.
Figure 33:
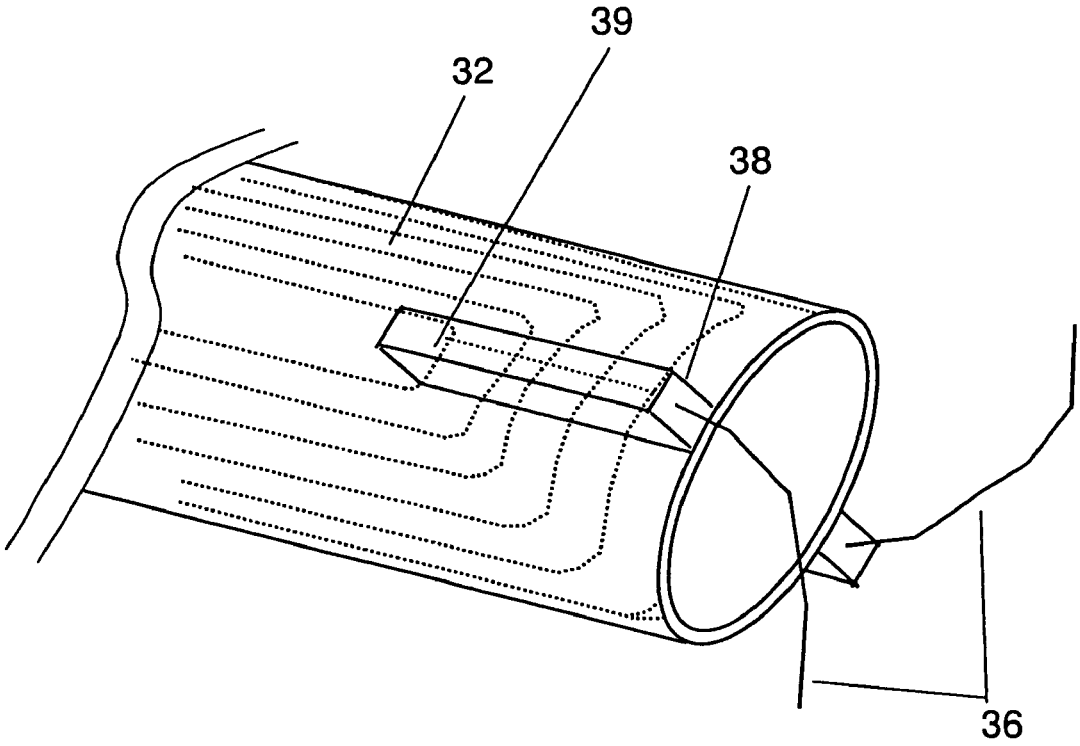
FIG. 33 shows wiring of a deflection yoke according to Embodiment 6.
Figure 34:
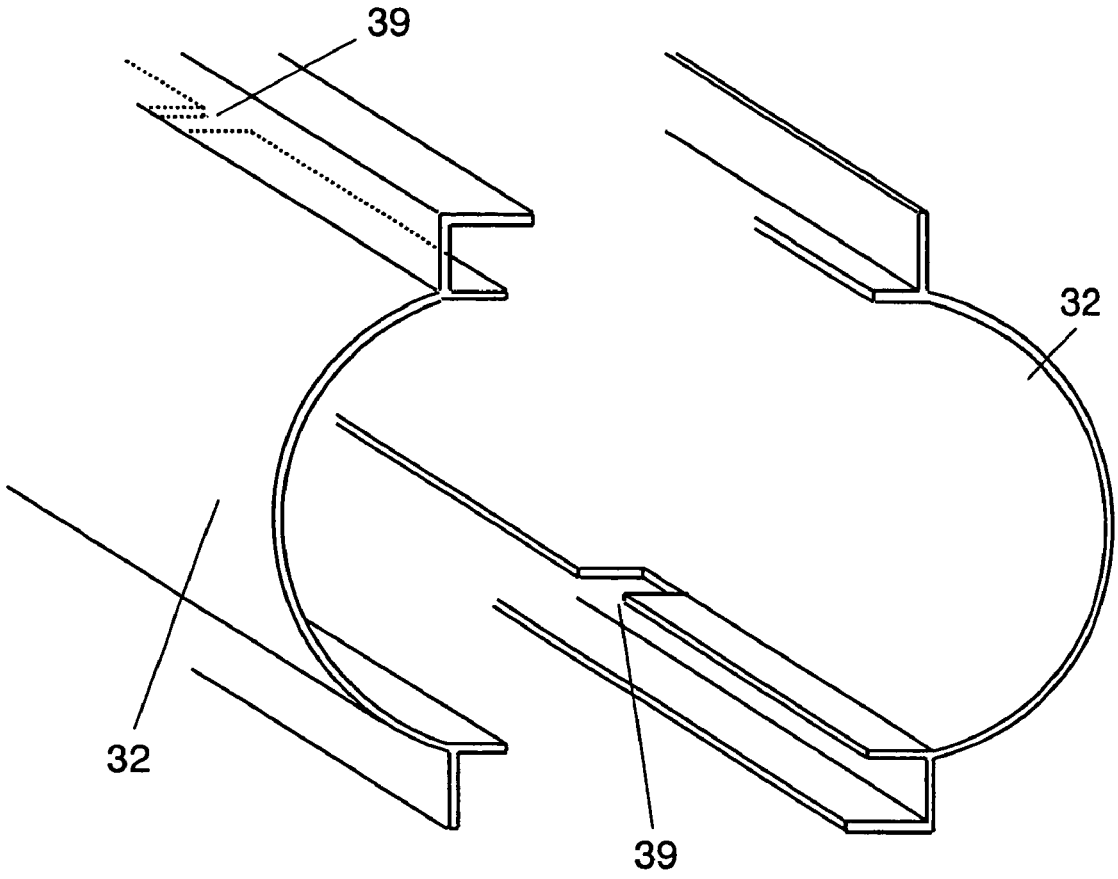
FIG. 34 is a perspective view of an insulating frame of the deflection yoke according to Embodiment 6.
Figure 35:
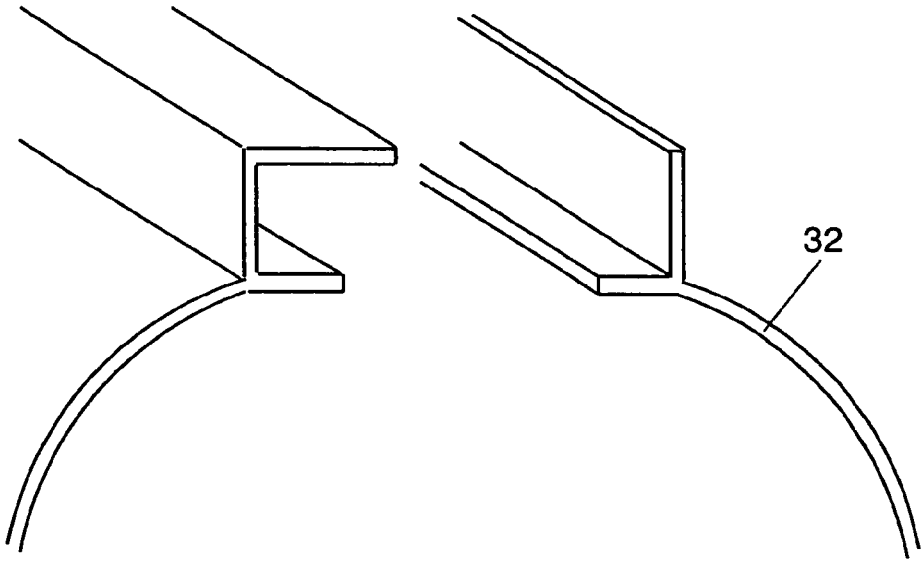
FIG. 35 is a perspective view of the insulating frame of the deflection yoke according to Embodiment 6.
Figure 36:
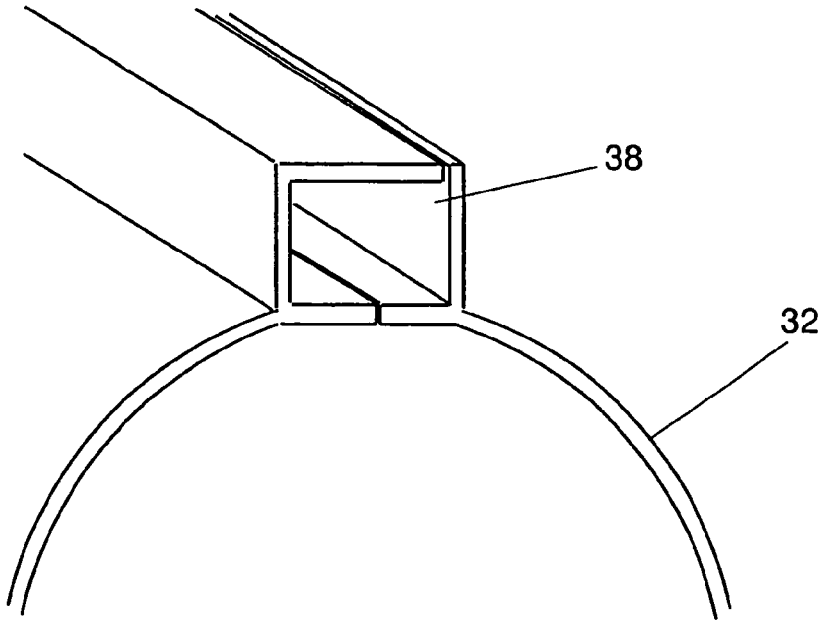
FIG. 36 is a perspective view of the insulating frame of the deflection yoke according to Embodiment 6.

FIG. 30 is a top view of a horizontal deflecting coil according to Exemplary Embodiment 6 of the present invention. FIG. 31 is a side view of the horizontal deflecting coil according to Embodiment 6. FIG. 32 is a sectional view of a deflection yoke of Embodiment 6. FIG. 33 is an explanatory diagram of wiring according to Embodiment 6. FIGS. 34, 35, and 36 are perspective views of an insulating frame according to Embodiment 6.

As shown in FIGS. 30 and 31, horizontal deflecting coil 15 has winding-start wire 36 and winding-end wire 37. It is necessary to insulate the winding start wire 36 led out toward an outer periphery of the coil so that the wire 36 does not contact a wire or coil having a potential different from that of the winding-start wire 36.

As shown in FIG. 32, the horizontal deflecting coil 15 of the deflection yoke of Embodiment 6 is partitioned by the insulating frame 32 from the vertical deflecting coil 31. The insulating frame 32 has cartridge portion 38 passing the winding-start wire 36 of the horizontal deflecting coil 15 through the portion 38. As shown in FIG. 33, the wiring-start wire 36 of the horizontal deflecting coil 15 passes through the cartridge portion 38 for wiring.

As shown in FIGS. 35 and 36, the cartridge portion 38 is formed by combining separated insulating frames 32. As shown in FIG. 34, the cartridge portion 38 has recess 39 provided therein. As shown in FIG. 33, the winding-start wire 36 is led into the cartridge portion 38 through the recess 39, and is then led out to the deflection yoke towards an electron gun.

Figure 37:
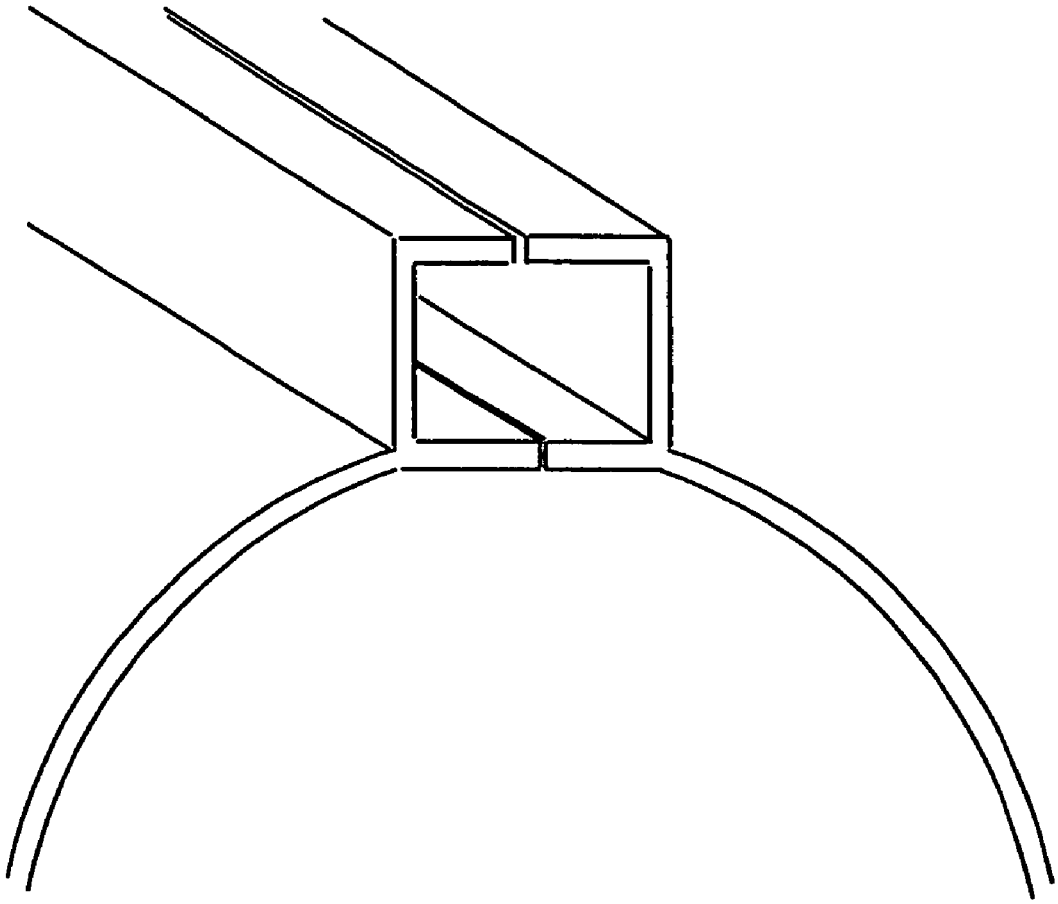
FIG. 37 is a perspective view of the insulating frame of the deflection yoke according to Embodiment 6.

The cartridge portion 38 and the recess 39, as shown in FIGS. 35 and 36, can be formed by combining a wall having an L-shape and a wall having an I-shape. The cartridge portion 38 and the recess 39, as shown in FIG. 37, may be formed by combining walls each having a squared U-shape.

Exemplary Embodiment 7

Figure 38:
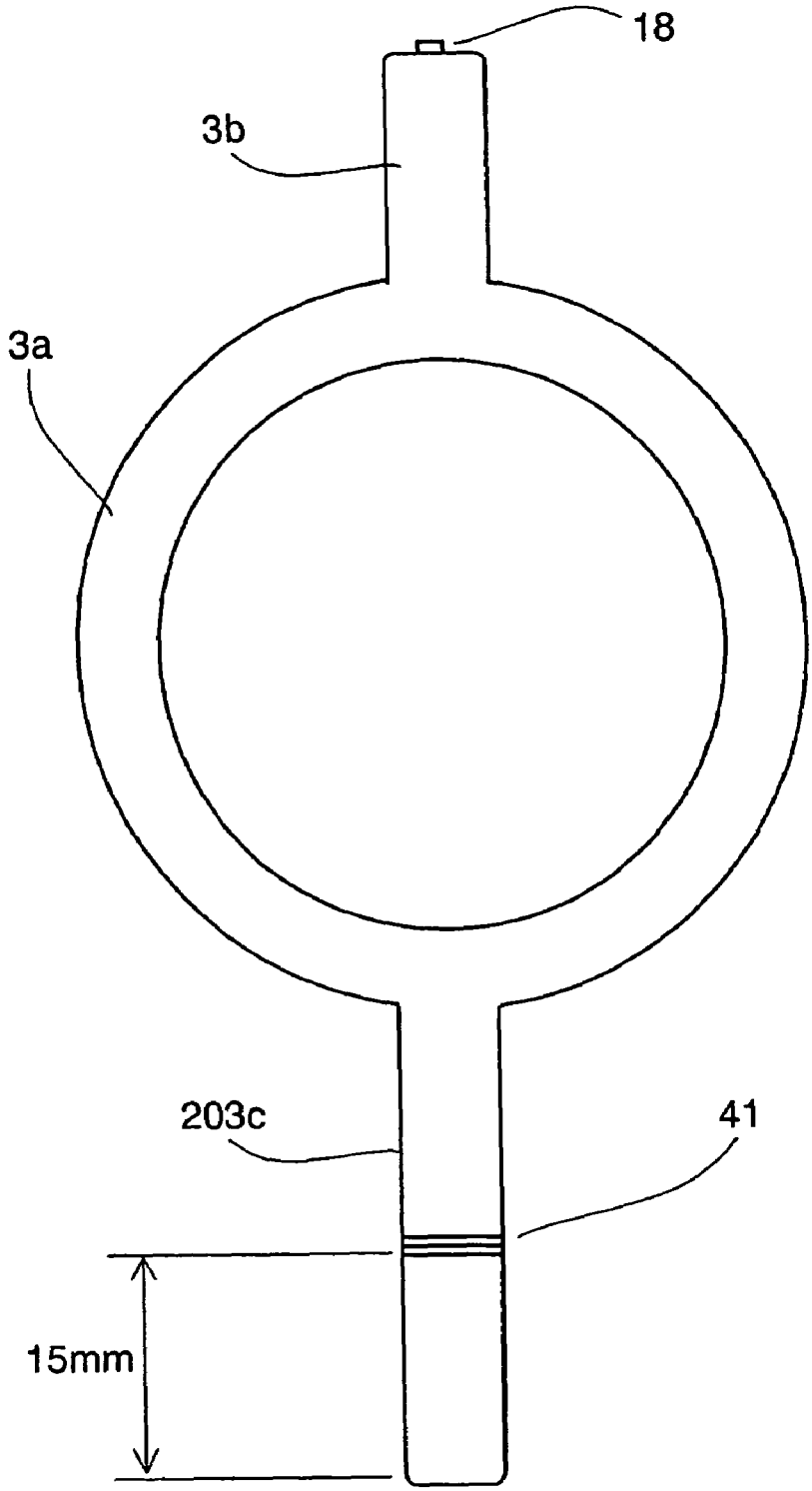
FIG. 38 is a plan view of a centering magnet of a deflection yoke according to Exemplary Embodiment 7 of the invention.
Figure 39:
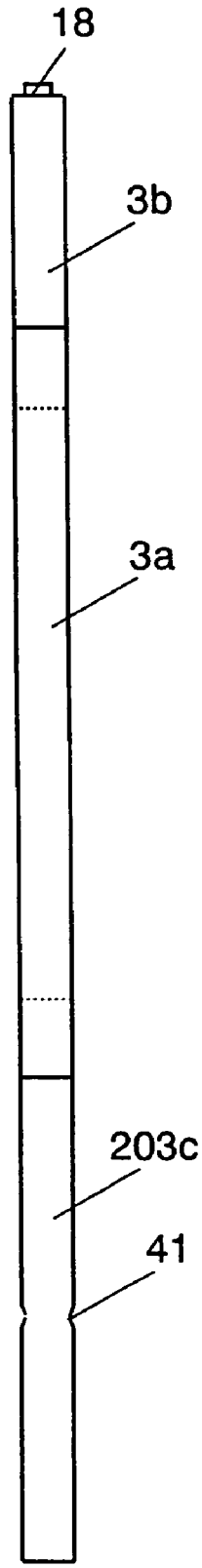
FIG. 39 is a side view of the centering magnet of the deflection yoke according to Embodiment 7.
Figure 40:
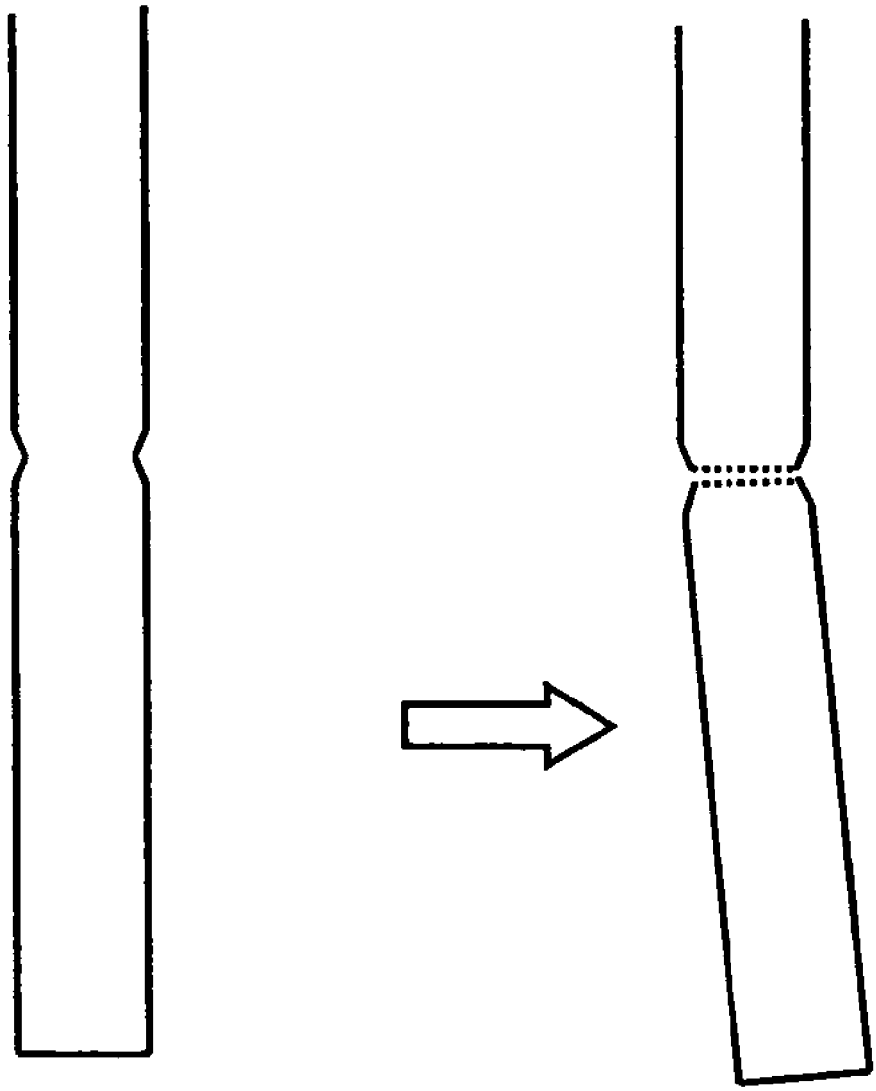
FIG. 40 is a side view of the centering magnet of the deflection yoke according to Embodiment 7.
Figure 41:
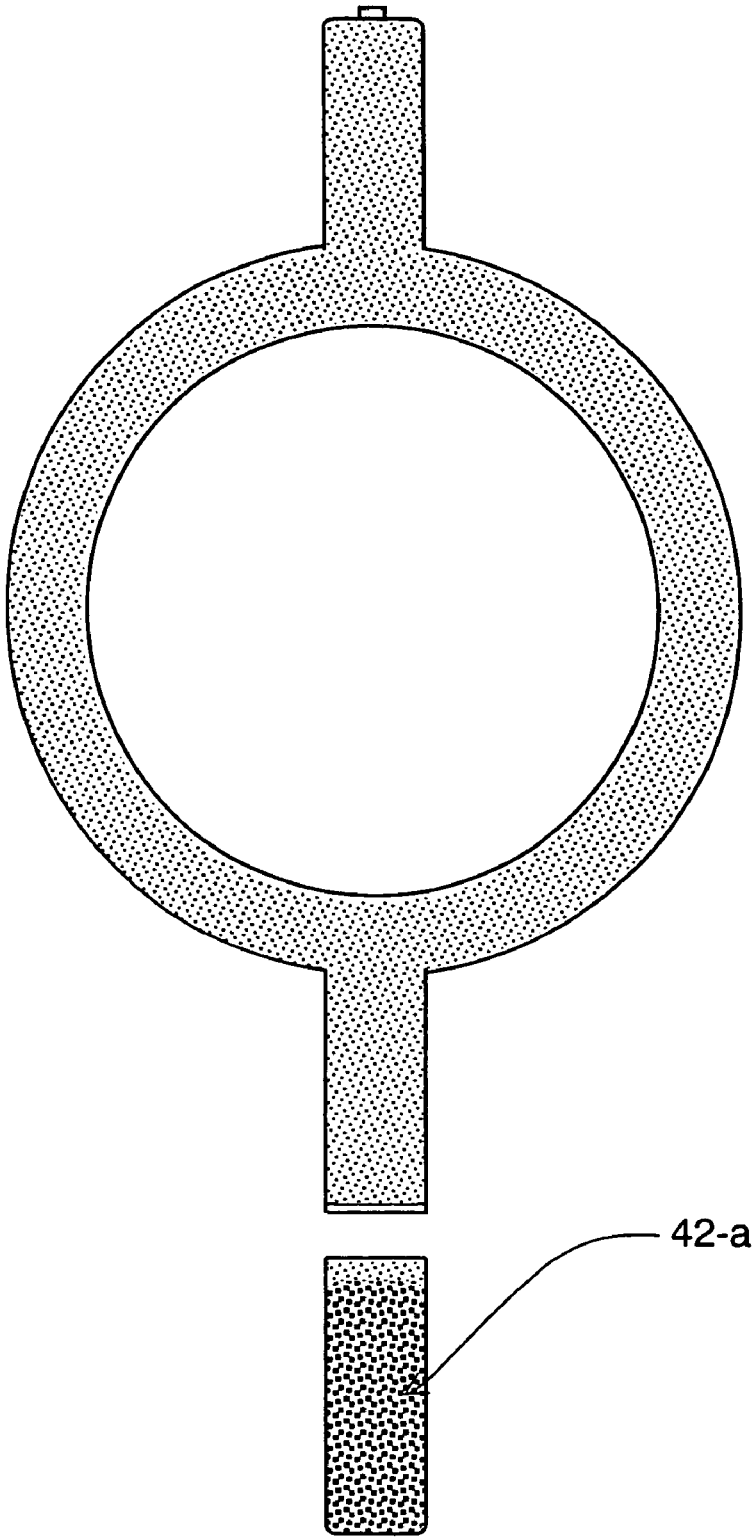
FIG. 41 is a plan view of the centering magnet of the deflection yoke according to Embodiment 7.

FIG. 38 is a plan view of a centering magnet of a deflection yoke according to Exemplary Embodiment 7 of the present invention. FIG. 39 is a side view of the centering magnet of Embodiment 7. FIG. 40 is a side view of the centering magnet having a knob portion cut off according to Embodiment 7. FIG. 41 is a plan view of the centering magnet of Embodiment 7.

Figure 1:
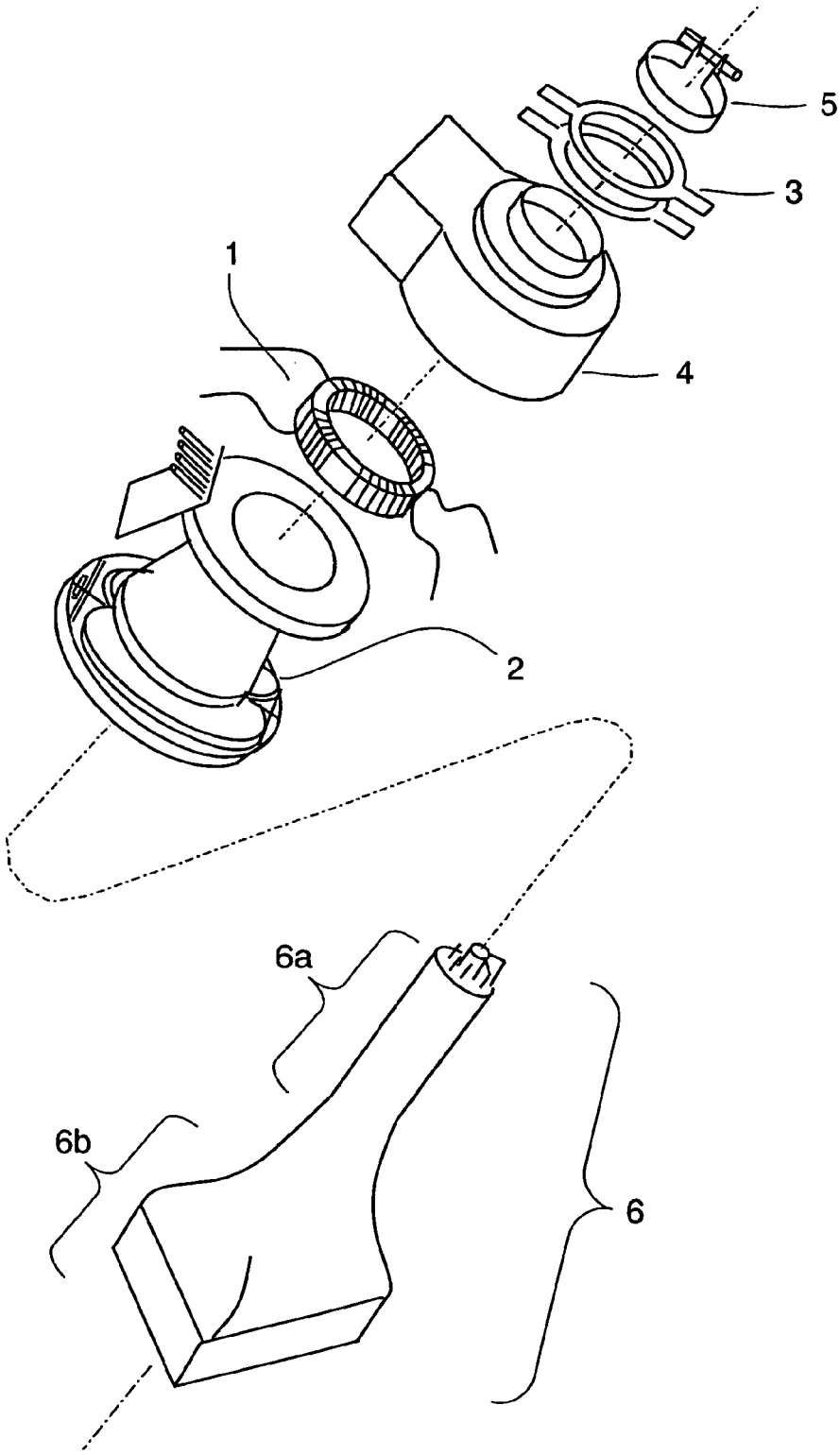
FIG. 1 shows a configuration of a deflection yoke.
Figure 2:
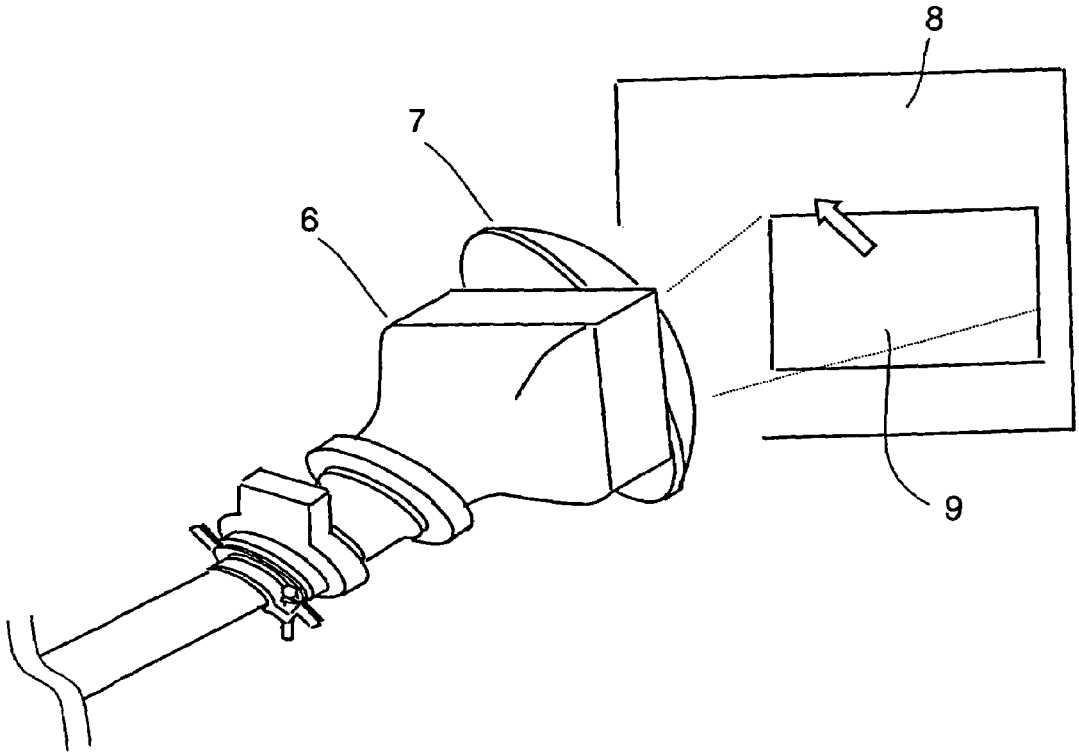
FIG. 2 shows an operation of the deflection yoke.
Figure 3:
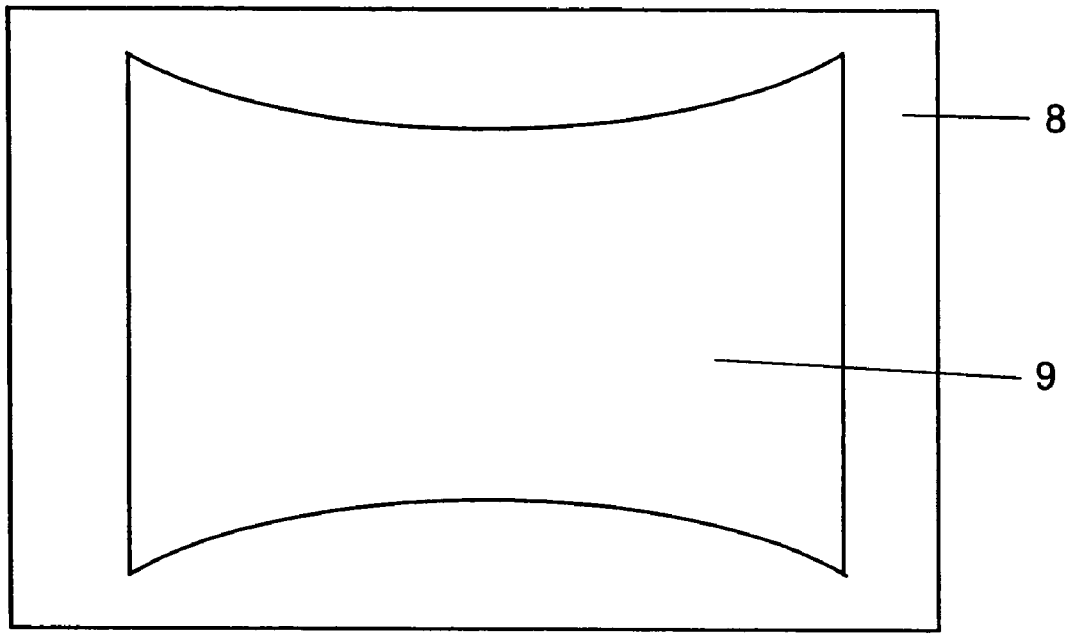
FIG. 3 shows distortion of a screen to be corrected by a sub-deflection yoke.
Figure 4:
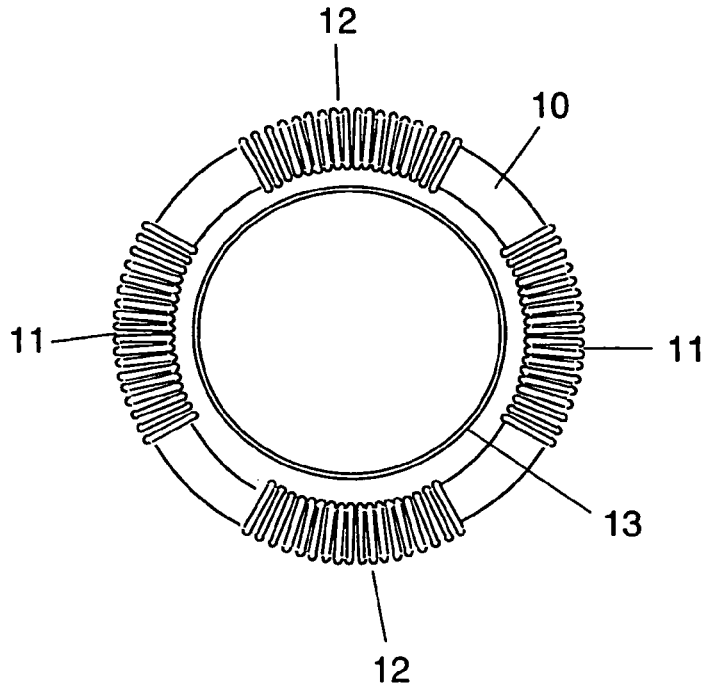
FIG. 4 shows a conventional sub-deflection yoke.
Figure 5:
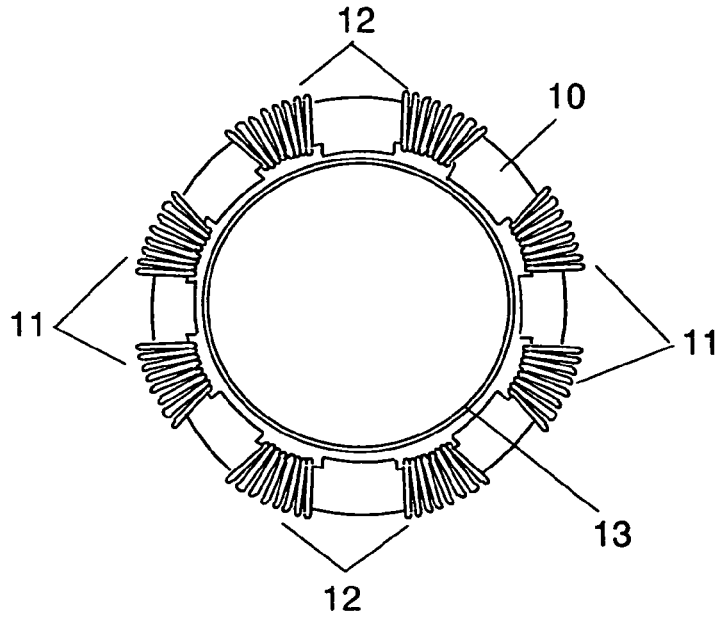
FIG. 5 shows another conventional sub-deflection yoke.
Figure 6:
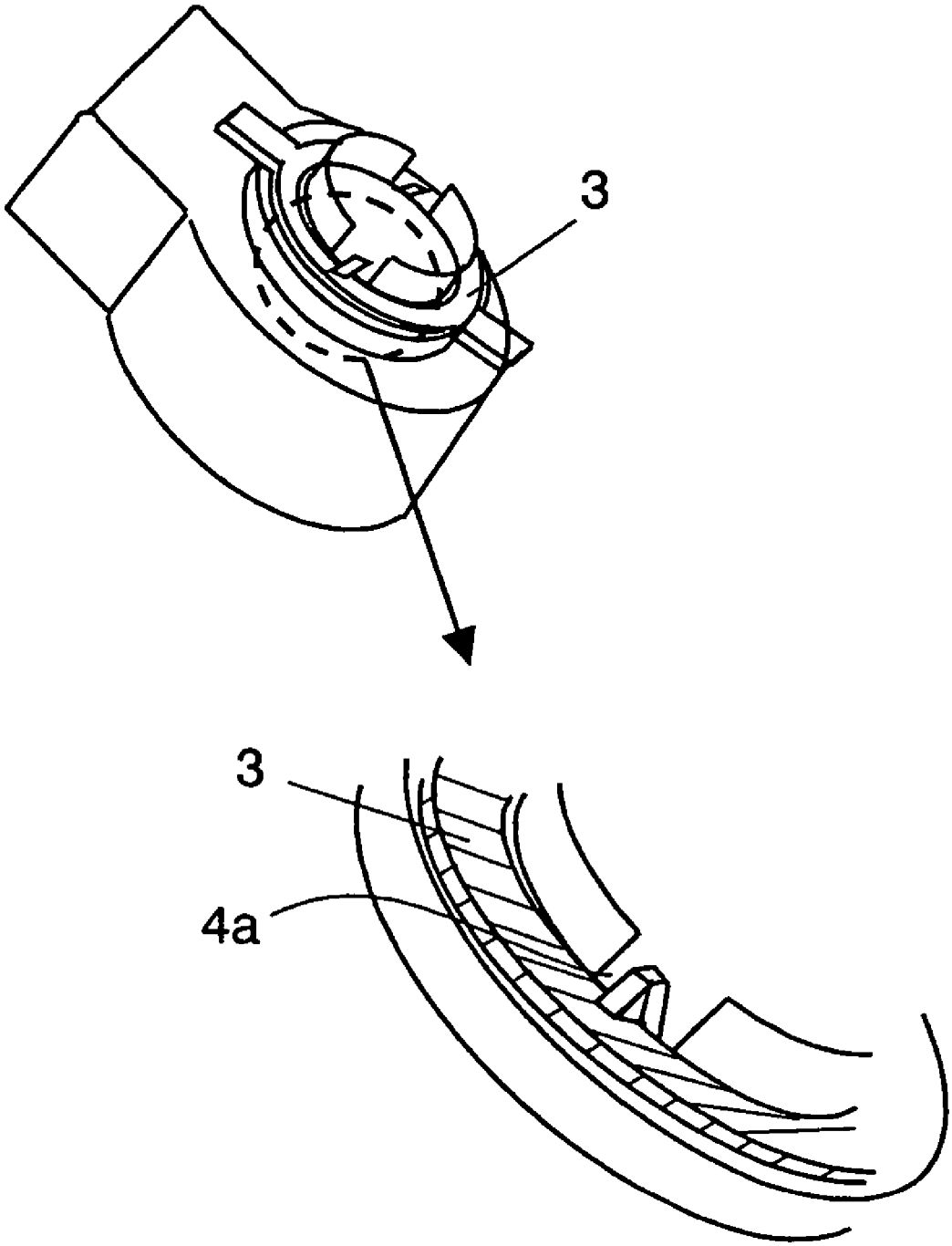
FIG. 6 shows a centering magnet provided at a deflection yoke.
Figure 7:
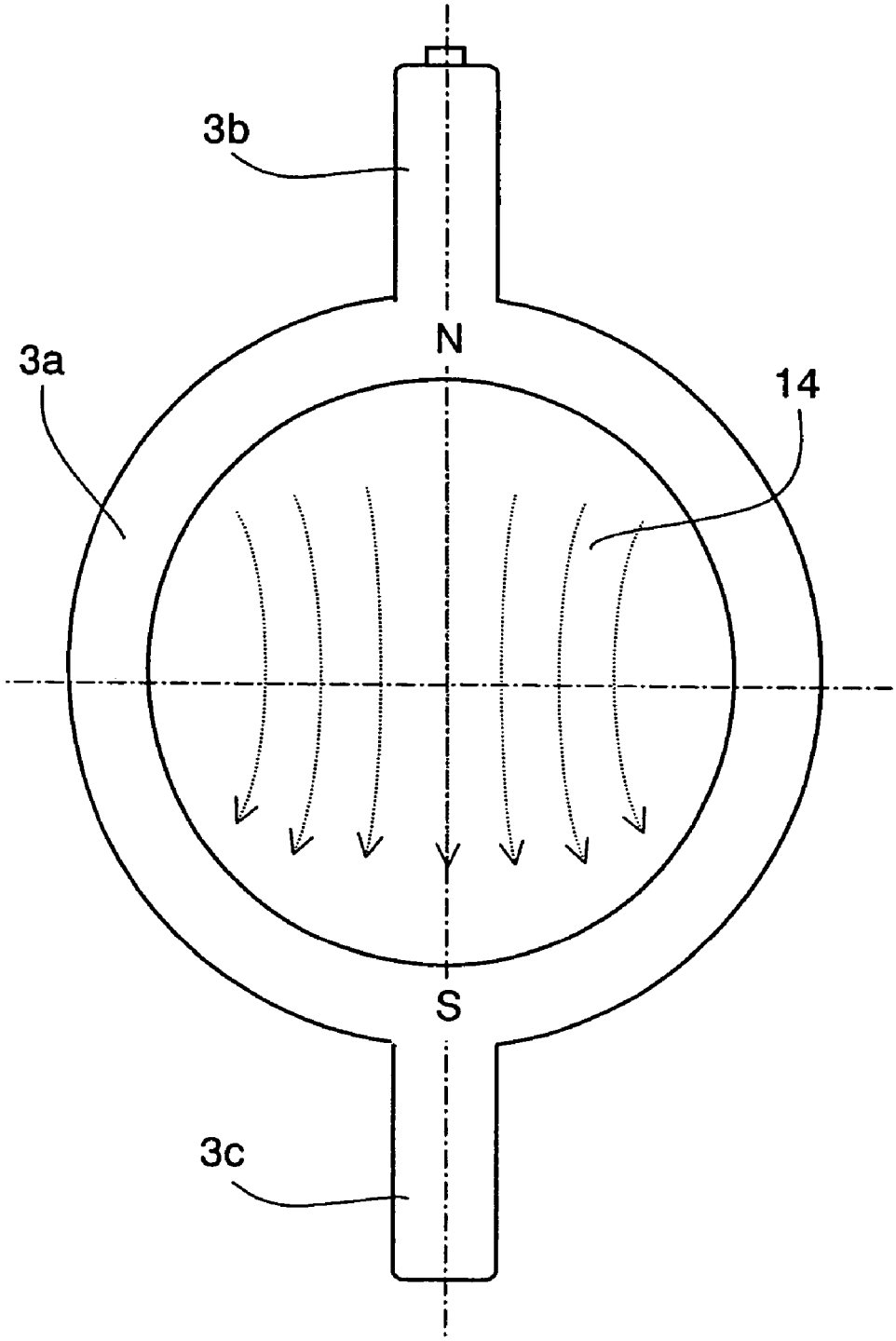
FIG. 7 shows a conventional centering magnet.
Figure 8:
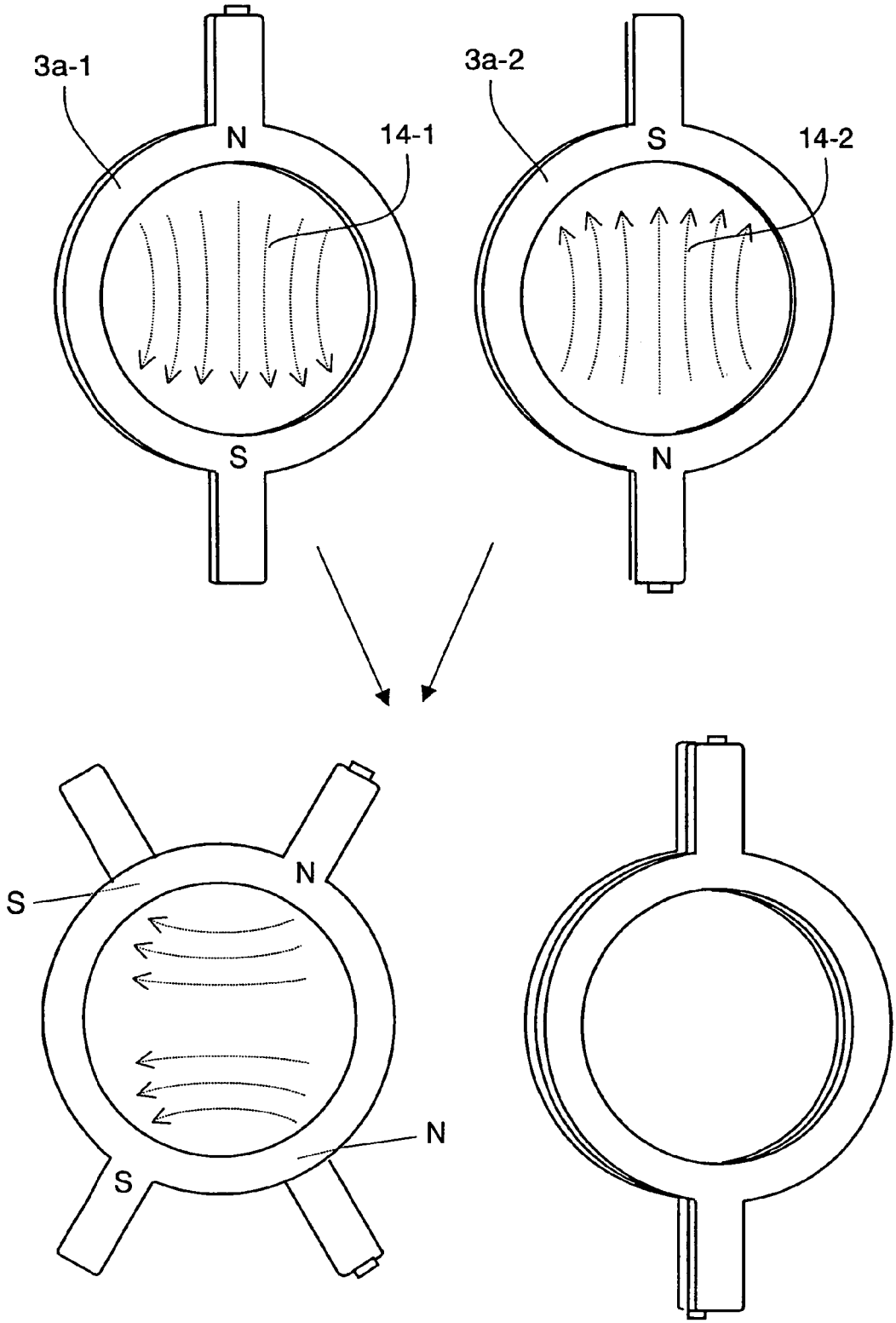
FIG. 8 shows a conventional centering magnet.

As shown in FIG. 7, the centering magnet includes a ring body 3*a* having an inner diameter of about 31 mm to 33 mm and an outer diameter of about 37 mm to 42 mm. The magnet further includes knob portions 3*b* and 3*c* provided at positions of the ring body 3*a*, and each of the portions 3*d* and 3*c* have a width of about 4 mm to 10 mm and a length of about 5 mm to 20 mm.

The centering magnet having a port 18 for resin molding at the end of knob portion 3*b* and is formed by injection molding with resin poured into the port 18. The thickness of the centering magnet ranges from about 1 mm to 1.5 mm, and the resin used for molding is plastic resin, such as nylon mixed with 10% to 20% of ferromagnetic powders, such as Alnico.

Figure 42:
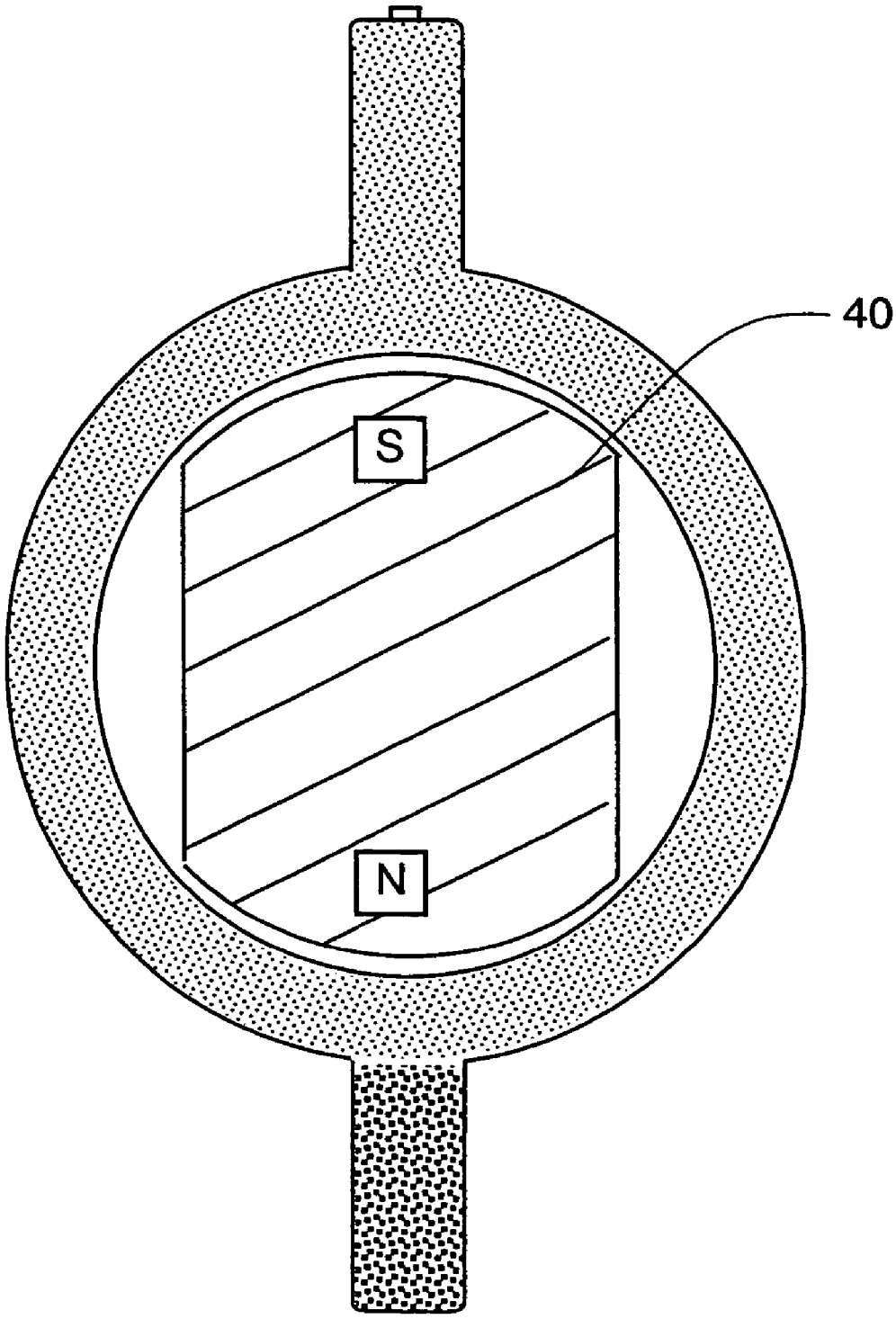
FIG. 42 shows a magnetizing yoke for magnetizing a centering magnet.
Figure 43:
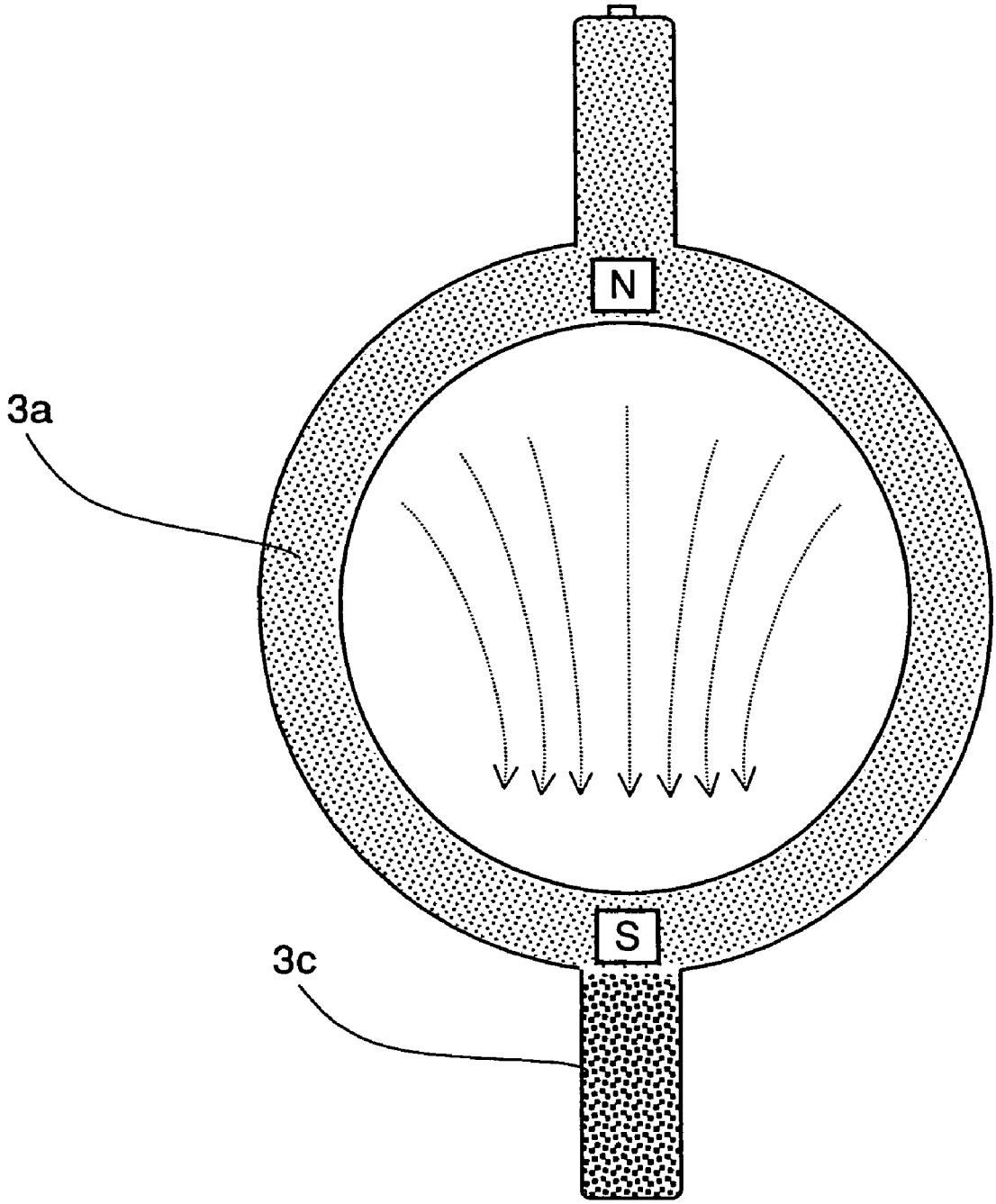
FIG. 43 shows magnetic lines generated by a conventional centering magnet.

While the plastic resin mixed with 10% of the Alnico powders is subjected to injection molding, a portion having a high mixing percentage of the Alnico powder has a small viscosity since a grain diameter of the Alnico powder is large, 90 μm. Therefore, knob portion 3*c*, which is opposite to port 18, of a conventional centering magnet is filled with a portion of the resin having a high density of the Alnico power during the injection molding. Upon being magnetized to have two poles, N pole and S pole, by polarizing yoke 40, as shown in FIG. 42, such molded body is magnetized a lot near knob portion 3*c*, which is opposite to port 18. This magnetizing makes magnetic lines inside the ring body 3*a* not symmetrical near the N pole and the S pole, as shown in FIG. 43.

In the centering magnet of the deflection yoke of Embodiment 7, knob portion 203*c* opposite to port 18 is previously formed longer by about 15 mm than the knob portion 3*b*, as shown in FIG. 38, and the knob portion 203 has a thin portion 41 provided therein.

The thickness of the thin portion 41 may range from one half to two thirds of the thickness of the centering magnet so that the knob portion 3*c* can be easily cut off after the molding. End portion 42-*a* containing ferromagnetic powder at the high density is separated at the thin portion 41, as shown in FIG. 41, thus allowing the centering magnet to be magnetized to have symmetrical magnetic lines inside the ring body 3*a*, as shown in FIG. 7.

Exemplary Embodiment 8

Figure 44:
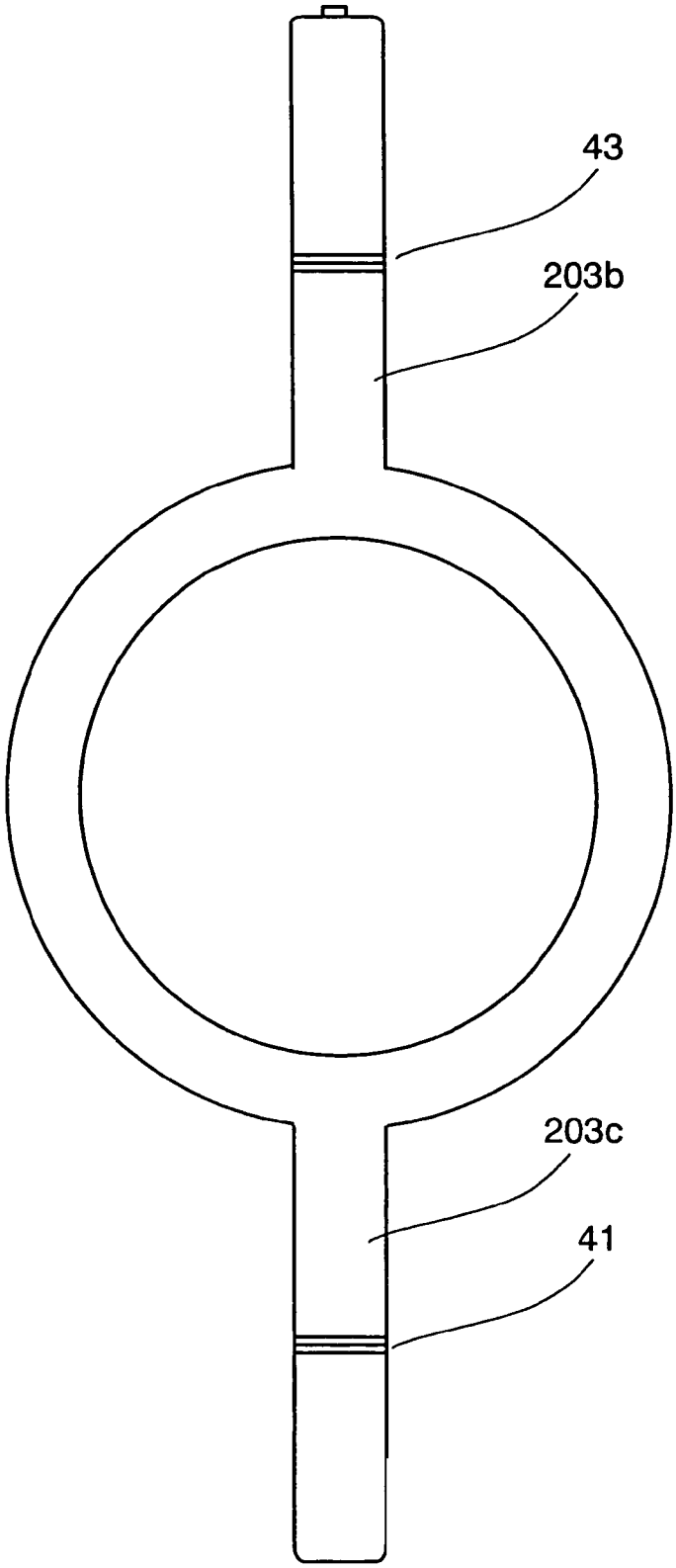
FIG. 44 is a plan view of a centering magnet of a deflection yoke according to Exemplary Embodiment 8 of the invention.

FIG. 44 is a plan view of a centering magnet of a deflection yoke according to Exemplary Embodiment 8 of the present invention.

A density of ferromagnetic material is the most uneven at port 18 and knob portion 3*c* provided at a side opposite to the port, while a portion of knob portion 3*b* including port 18 has a lower density of the ferromagnetic material than the density at the knob portion 3*c*. The knob portion 3*b* having the low density causes magnetic lines to become asymmetrical.

In the centering magnet of the deflection yoke of Embodiment 7, as shown in FIG. 44, port 18 and knob portion 203*c* at the side opposite to the port are previously formed longer by about 15 mm, and knob portion 203*c* has a thin portion 41 provided therein. Further, a portion of knob portion 203*b* including port 18 is formed longer by about 15 mm than the conventional knob portion and has a thin portion 43 provided therein.

Figure 45:
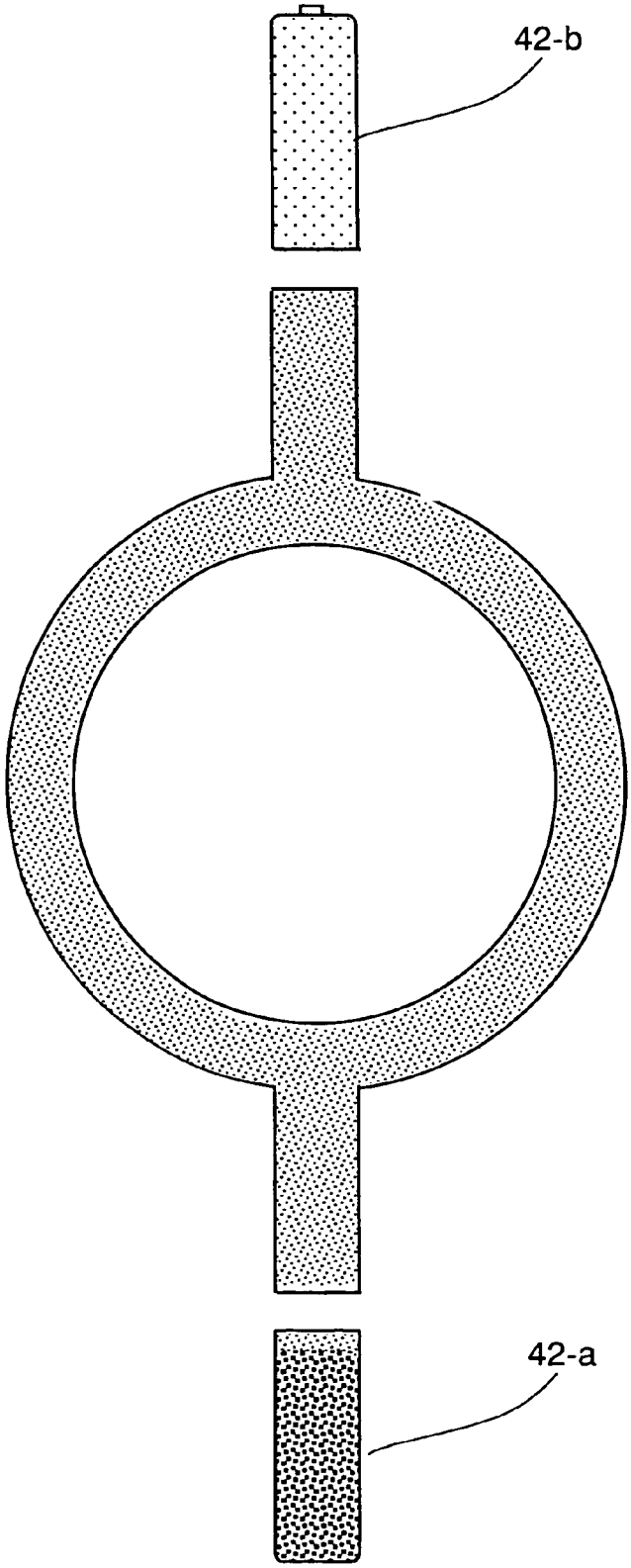
FIG. 45 is a plan view of the centering magnet of the deflection yoke according to Embodiment 8.

The thickness of thin portions 41 and 43 may range from one half to two thirds of the thickness of the centering magnet so that the knob portions 203*b* and 203*c* can be easily cut off after molding. Thus, as shown in FIG. 45, end portion 42-*a* containing ferromagnetic powder at a high density and end portion 42-*b* containing ferromagnetic powder at a low density can be separated from the centering magnet. Then, the centering magnet is magnetized to generate the magnetic lines inside the ring body 3*a*. The magnetic lines are symmetrical, as shown in FIG. 7.

What is claimed is:

1. A deflection yoke used for a cathode ray tube (CRT) including a glass tube having a screen surface and a straight portion for accommodating an electron gun, said deflection yoke comprising:

a main deflection yoke including first and second horizontal deflecting coils having substantially saddle shapes, said first and second horizontal deflection coils including respective first and second coil-connection-wire sections and respective first and second horizontal deflection sections, each of said first and second coil-connection-wire sections being wound in a direction perpendicular to a tube axis of said CRT and in a direction parallel to said straight portion, said first and second horizontal deflection sections being located towards said screen surface from said first and said second coil-connection-wire sections, respectively, and first and second vertical deflecting coils located outside said first and second horizontal coils; and a sub-deflection yoke provided at a side of said main deflection yoke towards said electron gun of said CRT.

2. The deflection yoke of claim 1, wherein said coil-connection-wire sections are piled up about an axis perpendicular to said tube axis in a direction parallel with said tube axis and along said straight portion.

3. The deflection yoke of claim 1, wherein a first diameter of each of outer curved surfaces of said first and said second horizontal deflection sections on a first plane where said first and second horizontal deflecting coils face each other is identical to a diameter of each of said outer curved surfaces of said horizontal deflection sections on a second plane perpendicular to said first plane and said tube axis, and wherein a second diameter of each of outer curved surfaces of said first and second coil-connection-wire sections on said second plane ranges from 1.05 to 1.35 times said first diameter of each of said outer curved surface of said first and second horizontal deflection sections.

4. The deflection yoke of claim 3, further comprising an insulating frame disposed between said first and second horizontal deflecting coil side and said first and second vertical deflecting coil side, wherein diameters of curved surfaces of said first and second vertical deflecting coils facing said CRT on a third plane where said first and second vertical deflecting coils face each other become smaller toward said electron gun from said screen surface and become larger at sides of said first and second vertical deflecting coils towards said electron gun, and said sides of said first and second vertical deflecting coils are combined with said first and second coil-connection-wire sections.

5. The deflection yoke of claim 1, further comprising a ferrite core mounted to said main deflection yoke, said ferrite core having a uniform inner diameter over an entire length of said ferrite core.

6. The deflection yoke of claim 4, wherein said horizontal deflecting coils have lead wires, and wherein said insulating frame has a cartridge portion parallel to said tube axis arranged to have said lead wire pass through said cartridge portion, said insulating frame having a recess formed therein for having said lead wire pass through said recess, and wherein said lead wire is led from said recess into said cartridge portion.

7. The deflection yoke of claim 1, further comprising a centering magnet provided in a direction towards said electron gun from said sub-deflecting coil, said centering magnet having a substantially-circular shape and including first and second knob portions at a periphery.

8. The deflection yoke of claim 7, wherein said centering magnet has a port for injection molding provided at an end of said first knob portion.

9. The deflection yoke of claim 8, wherein an end portion of said second knob portion is cut off after molding executed by applying resin mixed with magnetic material into said port.

10. The deflection yoke of claim 8, wherein said end of said first knob portion is cut off after molding executed by applying resin mixed with magnetic material into said port.

* * * * *